US008408216B2

(12) United States Patent
Luan et al.

(10) Patent No.: US 8,408,216 B2
(45) Date of Patent: Apr. 2, 2013

(54) FLAVOR CARRIER FOR USE IN SMOKING ARTICLES

(75) Inventors: Zhaohua Luan, Midlothian, VA (US); Diane L. Gee, Richmond, VA (US); Jay A Fournier, Richmond, VA (US); Kent B. Koller, Chesterfield, VA (US); Jose G. Nepomuceno, Beaverdam, VA (US)

(73) Assignee: Philip Morris USA Inc., Richmond, VA (US)

( * ) Notice: Subject to any disclaimer, the term of this patent is extended or adjusted under 35 U.S.C. 154(b) by 1396 days.

(21) Appl. No.: 11/019,090

(22) Filed: Dec. 22, 2004

(65) Prior Publication Data

US 2006/0130861 A1 Jun. 22, 2006

(51) Int. Cl.
*A24D 3/04* (2006.01)

(52) U.S. Cl. ..... 131/335; 131/337; 131/342

(58) Field of Classification Search ..... None
See application file for complete search history.

(56) References Cited

U.S. PATENT DOCUMENTS

| | | | | |
|---|---|---|---|---|
| 2,063,014 | A | 12/1936 | Allen | |
| 3,236,244 | A | 2/1966 | Irby, Jr. et al. | |
| 3,313,305 | A * | 4/1967 | Noznick et al. | 131/337 |
| 3,379,754 | A | 4/1968 | Bernstein | |
| 3,390,686 | A | 7/1968 | Irby, Jr. et al. | |
| 3,580,259 | A | 5/1971 | Luttich | |
| 3,625,224 | A | 12/1971 | Leffingwell | |
| 3,722,516 | A | 3/1973 | Suwa et al. | |
| 3,750,674 | A | 8/1973 | Miller | |
| 3,805,803 | A * | 4/1974 | Hedge et al. | 131/370 |
| 3,879,425 | A | 4/1975 | Hall et al. | |
| 3,881,025 | A | 4/1975 | Flament | |
| 3,884,247 | A | 5/1975 | Dietrich et al. | |
| 3,890,981 | A | 6/1975 | Vinals et al. | |
| 3,903,900 | A | 9/1975 | Wolt et al. | |
| 3,914,451 | A | 10/1975 | Schreiber et al. | |
| 3,915,175 | A | 10/1975 | Dietrich | |
| 3,920,027 | A | 11/1975 | Demole | |
| 3,924,644 | A | 12/1975 | Anderson et al. | |
| 3,937,228 | A | 2/1976 | Demole | |
| 3,943,943 | A | 3/1976 | Cartwright et al. | |
| 3,972,335 | A * | 8/1976 | Tiggelbeck et al. | 131/274 |

(Continued)

FOREIGN PATENT DOCUMENTS

| | | |
|---|---|---|
| GB | 338006 | 11/1930 |
| JP | 2000239694 A * | 9/2000 |

(Continued)

OTHER PUBLICATIONS

Shio, et al., "Morphological control of ordered mesoporous silica: formation of fine and rod-like mesoporous powders from completely dissolved aqueous solutions of sodium metasilicate and cationic surfactants", Royal Society of Chemistry, Chem. Commun., 1998, 2461-2462.*

(Continued)

*Primary Examiner* — Michael J Felton
(74) *Attorney, Agent, or Firm* — Buchanan Ingersoll & Rooney PC

(57) ABSTRACT

Flavor carriers, smoking articles, method of making flavor carriers, methods of making smoking articles, methods of flavoring gas streams such as mainstream tobacco smoke and methods of smoking are provided. The flavor carriers and smoking articles comprise a mesoporous molecular sieve and a flavor releasably disposed within the sieve.

15 Claims, 15 Drawing Sheets

FLAVOR LOADING AND DELIVERY MECHANISM (II)

U.S. PATENT DOCUMENTS

| | | | | |
|---|---|---|---|---|
| 4,311,156 | A | 1/1982 | Bonnet et al. | |
| 4,318,417 | A | 3/1982 | Hiroshi et al. | |
| 4,525,410 | A | 6/1985 | Hagiwara et al. | |
| 4,662,384 | A * | 5/1987 | Green | 131/335 |
| 4,729,391 | A | 3/1988 | Woods et al. | |
| 4,913,966 | A | 4/1990 | Garvey et al. | |
| 4,981,522 | A | 1/1991 | Nichols et al. | |
| 5,057,296 | A | 10/1991 | Beck | |
| 5,057,368 | A | 10/1991 | Largman et al. | |
| 5,098,684 | A | 3/1992 | Kresge et al. | |
| 5,102,643 | A | 4/1992 | Kresge et al. | |
| 5,108,725 | A | 4/1992 | Beck et al. | |
| 5,137,034 | A | 8/1992 | Perfetti et al. | |
| 5,144,967 | A * | 9/1992 | Cartwright et al. | 131/365 |
| 5,198,203 | A | 3/1993 | Kresge et al. | |
| 5,300,277 | A | 4/1994 | Kresge et al. | |
| 5,304,363 | A | 4/1994 | Beck et al. | |
| 5,322,075 | A | 6/1994 | Deevi et al. | |
| 5,362,697 | A | 11/1994 | Fung et al. | |
| 5,499,636 | A | 3/1996 | Baggett, Jr. et al. | |
| 5,538,711 | A | 7/1996 | Emerson et al. | |
| 5,666,976 | A | 9/1997 | Adams et al. | |
| 5,692,525 | A | 12/1997 | Counts et al. | |
| 5,692,526 | A | 12/1997 | Adams et al. | |
| 5,779,882 | A | 7/1998 | Chester et al. | |
| 5,863,515 | A | 1/1999 | Davis et al. | |
| 5,896,861 | A | 4/1999 | Veluz | |
| 5,915,387 | A | 6/1999 | Baggett, Jr. et al. | |
| 5,934,289 | A | 8/1999 | Watkins et al. | |
| 5,951,962 | A | 9/1999 | Muller et al. | |
| 5,958,369 | A | 9/1999 | Kosuge et al. | |
| 5,988,176 | A | 11/1999 | Baggett, Jr. et al. | |
| 6,026,820 | A | 2/2000 | Baggett, Jr. et al. | |
| 6,053,176 | A | 4/2000 | Adams et al. | |
| 6,096,288 | A | 8/2000 | Roth | |
| 6,119,699 | A | 9/2000 | Sung | |
| 6,174,512 | B1 | 1/2001 | Kosuge et al. | |
| 6,221,826 | B1 * | 4/2001 | Surutzidis et al. | 510/349 |
| 6,334,988 | B1 | 1/2002 | Gallis et al. | |
| 6,528,034 | B1 | 3/2003 | Pinnavaia et al. | |
| 6,584,979 | B2 * | 7/2003 | Xue et al. | 131/344 |
| 6,607,705 | B2 | 8/2003 | Pinnavaia et al. | |
| 6,696,258 | B1 | 2/2004 | Wei et al. | |
| 2002/0020420 | A1 | 2/2002 | Xue et al. | |
| 2002/0062833 | A1 | 5/2002 | Xue et al. | |
| 2002/0166563 | A1 * | 11/2002 | Jupe et al. | 131/331 |
| 2003/0024997 | A1 | 2/2003 | Welch et al. | |
| 2003/0031615 | A1 | 2/2003 | Satou et al. | |
| 2003/0037792 | A1 | 2/2003 | Snaidr et al. | |
| 2003/0154993 | A1 | 8/2003 | Paine, III et al. | |
| 2003/0157248 | A1 | 8/2003 | Watkins et al. | |

FOREIGN PATENT DOCUMENTS

| | | | |
|---|---|---|---|
| KR | 8102064 | | 12/1981 |
| KR | 9303904 | | 5/1993 |
| WO | 99/37705 | A1 | 7/1999 |
| WO | 01/80671 | A1 | 11/2001 |
| WO | 02/083994 | A1 | 10/2002 |

OTHER PUBLICATIONS

Doadrio, et al., "Mesoporous SBA-15 HPLC evaluation for controlled gentamicin drug delivery", Apr. 23, 2004, Journal of Controlled Release, 97 (2004), pp. 125-132.*

Kresge et al., "Molecular Sieves", Kirk Othmer Encyclopedia of Chemical Technology, 2004, John Wiley & Sons, Inc, vol. 16, p. 812.*

T. Yanagisawa et al., "The Preparation of Alkyltrimethylammonium-Kanemite Complexes and Their Conversion to Microporous Materials", *Bull. Chem. Soc. Jpn.*, vol. 63, No. 4, Apr. 1990, pp. 988-992.

Z. Luan et al., "Mesopore Molecular Sieve MCM-41 Containing Framework Aluminum", *J. Phys. Chem.*, vol. 99, No. 3, 1995, pp. 1018-1024.

J. Xu et al., "A Reliable Synthesis of Cubic Mesoporous MCM-48 Molecular Sieve", *Chem. Mater.*, vol. 10, No. 11, 1998, pp. 3690-3698.

Z. Luan et al., "Alumination and Ion Exchange of Mesoporous SBA-15 Molecular Sieves", *Chem. Mater.*, vol. 11, No. 6, 1999, pp. 1621-1627.

C. Yu et al., "Highly ordered large caged cubic mesoporous silica structures templated by triblock PEO—PBO-PEO copolymer", *Chem. Commun.*, 2000, pp. 575-576.

J. Am. Chem. Sec. 1998 120:6024-6036.

* cited by examiner

MESOPOROUS MATERIALS AS FLAVOR CARRIERS

FLAVOR CARRIER FOR USE IN SMOKING ARTICLES

BACKGROUND

Arrangements for enhancing taste of a smoking article are described, for example, in U.S. Pat. Nos. 2,063,014; 3,236,244; 3,390,686; 4,311,156; 4,318,417; 4,662,384; 4,729,391; 4,981,522; and 5,137,034; Korean Patent Nos. KR 9303904 and KR 8102064; British Patent No. 338,006; International Publication No. WO 01/80671A1 and U.S. Patent Application Publication No. U.S. 2002/006283A1.

Various flavoring components have been incorporated into tobacco products. Menthol is a common flavor component. However, the high degree of volatility and ease of sublimation of flavoring components such as menthol in tobacco products may result in a decreased shelf life of the products due to losses of flavorant. Additionally, on long term shipping and/or storage, cigarette packages may be subjected to elevated temperatures (i.e., in excess of room temperature) for extended periods of time. This exacerbates the challenges associated with conventional packaging in maintaining desirable levels of the flavor components.

It would be desirable to provide flavor carriers for volatile and heat sensitive flavor components that minimize the loss of the flavor components but which provide for their controllable release (e.g., during smoking).

SUMMARY

Flavor carriers, smoking articles, methods of making flavor carriers, methods of making smoking articles and methods of flavoring gases are provided. In preferred embodiments, a mesoporous molecular sieve is provided with a flavor releasably disposed therein so that the flavor is sufficiently contained but is releasable upon contact of the sieve with a moving gas such as, for example, smoke drawn through a smoking article.

In an exemplary embodiment a flavor carrier comprises (i) a mesoporous molecular sieve and (ii) a flavor releasably disposed within the sieve.

In another exemplary embodiment, a flavor carrier that enhances taste of a smoking article comprises (i) a mesoporous molecular sieve having a plurality of pores between about 20 Å and about 300 Å in size, the sieve having a surface area of 500 to 3000 $m^2/g$ and a pore volume of 0.5 to 3 $cm^3/g$ and (ii) a flavor releasably disposed within the sieve.

In yet another exemplary embodiment, a flavor carrier that enhances taste of a smoking article comprises (i) a mesoporous molecular sieve selected from the group consisting of FDU-1, MCM-41, MCM-48, SBA-15 and combinations thereof, the sieve having pores between about 20 Å and about 300 Å in size, the sieve having a surface area of 500 to 3000 $m^2/g$ and a pore volume of 0.5 to 3 $cm^3/g$, and (ii) a flavor selected from the group consisting of an acid, alcohol, ester, aldehyde, ketone, pyrazine, combinations or blends thereof and the like, wherein the flavor is releasably disposed within the sieve.

In another exemplary embodiment, a smoking article having enhanced taste comprises (i) tobacco, (ii) a sorbent and (iii) a flavor carrier, arranged so that the sorbent is positioned between the tobacco and the flavor carrier, wherein the flavor carrier comprises a mesoporous molecular sieve and a flavor releasably disposed within the sieve. In a preferred embodiment, the flavor is menthol releasably disposed in a molecular sieve having a pore size of about 50 to about 60 Å.

In another exemplary embodiment, a smoking article having enhanced taste comprises (i) tobacco, (ii) a sorbent and (iii) a flavor carrier, arranged so that the sorbent is positioned between the tobacco and the flavor carrier, wherein the flavor carrier comprises a mesoporous molecular sieve having pores between about 20 Å and about 300 Å in size, wherein the sieve has a surface area of 500 to 3000 $m^2/g$ and a pore volume of 0.5 to 3 $cm^3/g$, and a flavor releasably disposed within the sieve.

In another exemplary embodiment, a smoking article having enhanced taste comprises (i) tobacco, (ii) a sorbent, and (iii) a flavor carrier arranged so that the sorbent is positioned between the tobacco and the flavor carrier, wherein the carrier comprises a mesoporous molecular sieve selected from the group consisting of FDU-1, MCM-41, MCM-48, SBA-15 and combinations thereof, the sieve having pores between about 20 Å and about 300 Å in size, the sieve having a surface area of 500 to 3000 $m^2/g$ and a pore volume of 0.5 to 3 $cm^3/g$, and a flavor selected from the group consisting of acid, alcohol, ester, aldehyde, ketone, pyrazine, combinations or blends thereof and the like, wherein the flavor is releasably disposed within the sieve.

In another exemplary embodiment, a smoking article having enhanced taste comprises (i) tobacco, and (ii) a flavor carrier, wherein the flavor carrier comprises a mesoporous molecular sieve and a flavor releasably disposed within the sieve. In a still further embodiment a smoking article having improved taste comprises: (i) a tobacco rod; and (ii) a filter joined to said tobacco rod, the filter comprising a plug/space/plug configuration comprising a downstream plug; an upstream plug, and a space between said downstream plug and said upstream plug, wherein said smoking article further comprises a flavor carrier comprising a mesoporous molecular sieve and a flavor releasably disposed within the sieve, said flavor carrier incorporated in at least one of said downstream plug, said upstream plug and said space.

Another exemplary embodiment provides a method of making a flavor carrier, the method comprising (i) providing a mesoporous molecular sieve and (ii) introducing a flavor into the sieve so that the flavor is releasably disposed therein.

Yet another exemplary embodiment provides a method of making a flavor carrier for enhancing taste of a smoking article, the method comprising (i) providing a mesoporous molecular sieve having pores between about 20 Å and 300 Å in size, the sieve having a surface area of 500 to 3000 $m^2/g$ and a pore volume of 0.5 to 3 $cm^3/g$, and (ii) introducing a flavor into the sieve so that the flavor is releasably disposed therein.

Another exemplary embodiment provides a method of making a flavor carrier for enhancing taste of a smoking article, the method comprising (i) providing a mesoporous molecular sieve selected from the group consisting of FDU-1, MCM-41, MCM-48, SBA-15 and combinations thereof, the sieve having pores between about 20 Å and about 300 Å in size, the sieve having a surface area of 500 to 3000 $m^2/g$ and a pore volume of 0.5 to 3 $cm^3/g$, and (ii) introducing a flavor selected from the group consisting of an acid, alcohol, ester, aldehyde, ketone, pyrazine, combinations or blends thereof and the like into the sieve so that the flavor is releasably disposed therein.

Also provided is a method of making a smoking article, the method comprising providing tobacco, a sorbent, and a flavor carrier, arranged so that the sorbent is positioned between the tobacco and the flavor carrier, the flavor carrier comprising a mesoporous molecular sieve and a flavor releasably disposed within the sieve.

In another exemplary embodiment, a method of making a smoking article comprises providing tobacco, a sorbent and a flavor carrier, arranged so that the sorbent is positioned between the tobacco and the carrier, the flavor carrier comprising a mesoporous molecular sieve having pores between about 20 Å and about 300 Å in size, the sieve having a surface area of 500 to 3000 $m^2/g$ and a pore volume of 0.5 to 3 $cm^3/g$, and a flavor releasably disposed within the sieve.

In another exemplary embodiment a method of making a smoking article comprises providing tobacco, a sorbent and a flavor carrier, arranged so that the sorbent is positioned between the tobacco and the carrier, the carrier comprising a mesoporous molecular sieve selected from the group consisting of FDU-1, MCM-41, MCM-48, SBA-15 and combinations thereof, the sieve having pores between about 20 Å and about 300 Å in size, the sieve having a surface area of 500 to 3000 $m^2/g$ and a pore volume of 0.5 to 3 $cm^3/g$, and a flavor selected from the group consisting of acid, alcohol, ester, aldehyde, ketone, pyrazine, combinations or blends thereof and the like, the flavor being releasably disposed within the sieve.

Also provided is a method of flavoring a gas stream, the method comprising providing a flavor carrier relative to a moving gas stream so that the gas stream contacts the flavor carrier, the flavor carrier comprising a mesoporous molecular sieve having a flavor releasably disposed within the sieve so that the flavor is released when the gas stream contacts the carrier.

Also provided is a method of making a smoking article, the method comprising providing tobacco and a flavor carrier, the flavor carrier comprising a mesoporous molecular sieve and a flavor releasably disposed within the sieve.

In another exemplary embodiment, a method of flavoring a gas stream comprises providing a flavor carrier relative to a moving gas stream so that the gas stream contacts the flavor carrier, the flavor carrier comprising a mesoporous molecular sieve having pores between about 20 Å and about 300 Å in size, the sieve having a surface area of 500 to 3000 $m^2/g$ and a pore volume of 0.5 to 3 $cm^3/g$, and a flavor releasably disposed within the sieve so that the flavor is released when the gas stream contacts the carrier.

In yet another exemplary embodiment, a method of flavoring a gas stream comprises providing a flavor carrier relative to a moving gas stream so that the gas stream contacts the flavor carrier, the flavor carrier comprising a mesoporous molecular sieve selected from the group consisting of FDU-1, MCM-41, MCM-48, SBA-15 and combinations thereof, the sieve having pores between about 20 Å and about 300 Å in size, the sieve having a surface area of 500 to 3000 $m^2/g$ and a pore volume of 0.5 to 3 $cm^3/g$, and a flavor selected from the group consisting of an acid, alcohol, ester, aldehyde, ketone, pyrazine, combinations or blends thereof and the like, the flavor being releasably disposed within the sieve so that the flavor is released when the gas stream contacts the carrier.

An exemplary embodiment of a method of treating mainstream tobacco smoke comprises heating or lighting a smoking article to form mainstream tobacco smoke, and drawing mainstream tobacco smoke through the article such that the flavor in the flavor carrier is released into the mainstream tobacco smoke when the smoke contacts the carrier. The smoking article can be a traditional or non-traditional cigarette.

DETAILED DESCRIPTION

Figure 1:
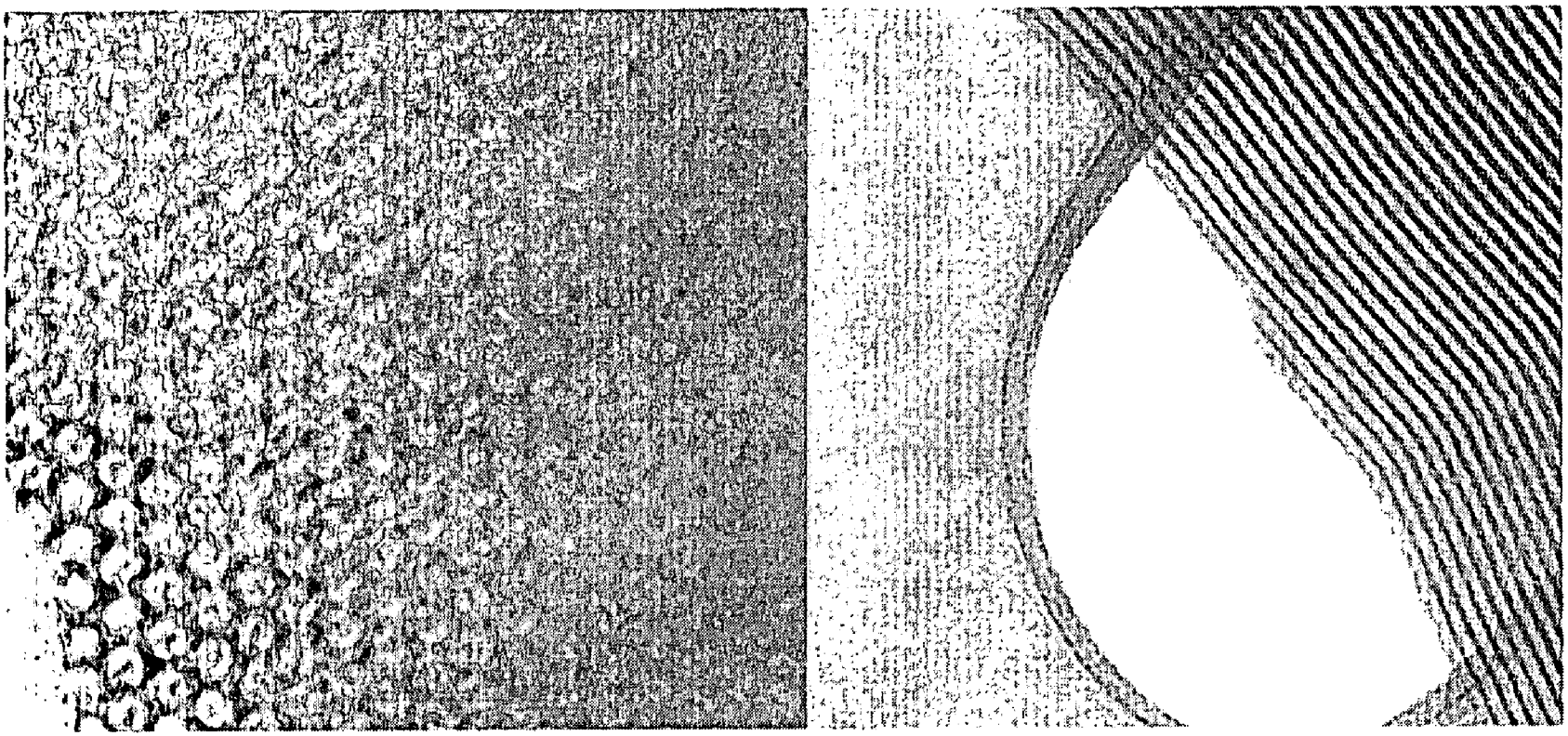
FIG. 1 is a photograph taken perpendicular to the pore axis of an exemplary mesoporous molecular sieve.

Flavor carriers are provided that include a mesoporous molecular sieve and a flavor releasably disposed therein. The flavor carrier is effective to contain a flavor and release the flavor when contacted by a moving gas stream that may comprise an aerosol such as, for example, tobacco smoke or cigarette smoke drawn through a smoking article. Smoking articles comprising the flavor carrier, methods of making the flavor carrier, methods of making smoking articles, methods of flavoring a gas stream and methods of treating mainstream tobacco smoke.

Preferred embodiments of the flavor carrier are useful for enhancing taste of various smoking articles, including, but not limited to, cigarettes, pipes, cigars, non-traditional cigarettes and the like.

The term "mesoporous molecular sieve" as used herein refers to a porous structure composed of an inorganic material. In exemplary embodiments, mesoporous molecular sieves have uniform channels or pores of mesopore-sized dimensions. In preferred embodiments, the mesoporous molecular sieve can be selected from amorphous, paracrystalline and/or polycrystalline porous silica materials having pores, cavities and/or channels ranging from 20 Å to 300 Å, for example, FDU-1, MCM-41, MCM-48 and SBA-15, combinations thereof and the like. The synthesis of a caged cubic mesoporous structure designated FDU-1 is disclosed by C. Yu, et al. in Chem. Comm., 575-576 (2000). Mesoporous silicates are described, for example, in patents relating to MCM-41 and MCM-48 and SBA-15; such as U.S. Pat. Nos.

5,098,684, 5,102,643 and 5,108,725, which are all hereby incorporated by reference in their entirety.

As is known in the art, mesoporous molecular sieves can be synthesized using a liquid crystal templating "LCT" mechanism. For example, hexagonally packed mesoporous silicate and aluminosilicate materials with uniform pore sizes can be prepared by liquid crystal templating. The synthesis proceeds by the use of surfactant micelles as structure directing agents in a sol-gel process. Amphiphillic surfactants self assemble into cylindrical micelles, which are encapsulated by an inorganic material (e.g., silicate or aluminosilicate) that balances the charge on the micellular surfaces. Calcination is then used to remove the organic surfactant leaving a hexagonal arrangement of mesopores. The preparation of mesoporous materials via liquid crystal templating is disclosed in U.S. Pat. Nos. 6,696,258; 5,958,369 and 5,863,515, which are incorporated herein by reference.

Mesoporous materials have physical characteristics that make them well-suited for use as flavor carriers. It has been found that the pore size of mesoporous molecular sieve material can be selected as a function of a flavor compound to be delivered. A preferred mesoporous material has a substantially uniform pore structure with pores or channels arranged in a honeycomb-like array. For menthol flavor delivery, SBA-15 silica having pores with a diameter of about 50 to 60 Å provides menthol retention. Depending on the flavor to be delivered, the mesoporous materials preferably possess substantially uniform mesopore channels or pores varying in size from about 20 Å to about 300 Å. Additionally, preferred mesoporous materials have a high pore volume of 0.5 to 3 $m^3/g$ and a high surface area of 500 to 3000 $m^2/g$, more preferably 500 to 2000 $m^2/g$. Such properties can be determined by known measurement techniques using nitrogen absorption at 77K. The mesoporous material preferably has a surface chemistry and particle morphology tailored to achieve optimal flavor containment (retention) and delivery.

Smoking articles, such as cigarettes, pipes, and cigars, as well as non-traditional cigarettes, are provided. Non-traditional cigarettes include, for example, cigarettes for electrical smoking systems as described in commonly-assigned U.S. Pat. Nos. 6,026,820; 5,988,176; 5,915,387; 5,692,526; 5,692,525; 5,666,976; and 5,499,636, the disclosures of which are incorporated by reference herein in their entireties.

The term "flavor" or "tobacco flavor" can include any flavor compound or tobacco extract suitable for being releasably disposed within a mesoporous molecular sieve to enhance the taste of a gas stream such as smoke produced, for example, by a smoking article. Preferred flavor compounds can include compounds selected from the group consisting of an acid, an alcohol, an ester, an aldehyde, a ketone, a pyrazine, combinations or blends thereof and the like. In a preferred embodiment, flavor compounds are substantially similar in molecular size, have diversified functional groups and tastes, and are compatible with other flavor compounds. The flavor compound can be selected, for example, from the group consisting of phenylacetic acid, solanone, megastigmatrienone, essential oil, spearmint, peppermint, cocoa, cinnamon, cinnamic acid, licorice, citrus, 2-heptanone, benzylalcohol, cis-3-hexenyl acetate, valeric acid, valeric aldehyde, menthol, vanilla, ester, terpene, sesquiterpene, nootkatone, maltol, damascenone, pyrazine, lactone, anethole, iso-valeric acid, combinations thereof and the like. A preferred flavor compound is menthol and a preferred flavor carrier is SBA-15. Such tobacco flavorants are disclosed, for example, in U.S. Pat. Nos. 3,580,259; 3,625,224; 3,722,516; 3,750,674; 3,879,425; 3,881,025; 3,884,247; 3,890,981; 3,903,900; 3,914,451; 3,915,175; 3,920,027; 3,924,644; 3,937,228; 3,943,943; 3,568,387 and 3,379,754, the disclosures of which are incorporated herein by reference.

The term "uniform" when used herein to describe the arrangement, distribution and/or orientation of pores on the surface of the mesoporous sieve means that the pores are arranged in substantially the same size form, manner, or degree such that they have a substantially unvaried appearance on the surface of the sieve or are substantially arranged in a pattern, as opposed to being randomly distributed over the surface of the sieve.

The term "releasably disposed" as used herein to refer to the flavor's containment in the sieve means that the sieve has a pore size effective to contain and substantially avoid or minimize unwanted migration of the flavor, such as, for example, during storage, but the flavor is mobile enough to be released from the sieve when the sieve is contacted by a moving gas stream such as, for example, mainstream tobacco smoke drawn through a smoking article.

The term "smoke" or "mainstream smoke" includes mixtures of gases which pass down a smoking article such as a tobacco portion and through a filter end of a cigarette.

Preferred embodiments of the flavor carrier are useful for various smoking articles, for example, cigarettes, pipes, cigars, and non-traditional cigarettes.

A "sorbent" is a substance that can condense or hold molecules of other substances on its surface, and/or take up other substances, i.e., through penetration of the other substances into its inner structure, or into its pores. As used herein, the term "sorbent" refers to either an adsorbent, an absorbent, or a substance that can perform both of these functions. The term "sorption" denotes filtration by adsorption and/or absorption. Sorption is intended to encompass interactions on the outer surface of the sorbent, as well as interactions within the pores and channels of the sorbent.

As used herein, the term "remove" refers to adsorption and/or absorption of at least some portion of a constituent of a gas stream such as mainstream tobacco smoke.

Microporous materials (i.e., microporous sorbents) such as, for example, activated carbon have been used to filter gas components from cigarette smoke. However, microporous sorbents can hinder a cigarette designer's ability to add volatile flavor components such as, for example, menthol to cigarette smoke. In particular, microporous sorbents tend to adsorb and/or absorb the flavor components during the time between cigarette manufacture and smoking by the consumer. Two problems occur when the flavor component migrates to and is adsorbed/absorbed by the microporous sorbent. First, the flavor component can occupy active sites in the microporous sorbent, thereby reducing the sorbent's ability to remove targeted gas phase components from smoke. Second, because the flavor component is often strongly adsorbed/absorbed by the microporous sorbent, the flavor component may not be sufficiently releasable.

The flavor carrier preferably comprises a mesoporous material (i.e., molecular sieve) with a pore size effective to retain a particular volatile flavor. While not wishing to be bound by theory, it is believed that if the pore size is too small, vapor pressure of the flavor compound will be insufficient and the flavor will be too strongly adsorbed to be released efficiently during use of the smoking article, whereas if the pore size is too large, the flavor compound will have a stronger propensity to diffuse out of the pores and migrate to other parts of the smoking article. Thus, in a preferred embodiment the pore size of the mesopore material is designed to achieve a balance between flavor containment (retention) and releasability. When the pores become saturated by the flavor (adsorbate), the vapor pressure of the flavor is reduced in a proportional relationship to the pore size of the sorbent. This relationship is expressed by Kelvin's equation:

$$\ln(P_s/P_o) = \frac{-4\gamma V_m}{RTD}\cos\Theta = \frac{-K}{D};$$

where $P_s$ is the capillary equilibrium vapor pressure, $\gamma$ is the liquid surface tension, $V_m$ is the molar volume of the condensed adsorbate, $\theta$ is the contact angle between the solid and condensed phases (usually taken to be zero), D is the mean radius of curvature of the liquid meniscus, $P_s/P_0$ is the relative vapor pressure (with $P_0$ being the saturated vapor pressure of the unconfined/bulk flavorant), R is the universal gas constant and T is the absolute temperature.

Accordingly, the pore size of the mesoporous sieve can be tailored, based on the nature of the flavor compound, to (1) reduce the vapor pressure of the flavor compound and minimize migration during storage; and (2) to allow for the displacement or delivery of the flavor compound into a gas stream, such as, for example, smoke drawn through a smoking article when the sieve is contacted by the gas stream. Thus, mesoporous materials having a uniform pore size in a selected range tailored to the flavor compound can be used to deliver the flavor compound to a moving gas stream.

In an exemplary embodiment, a flavored smoking article can include a microporous sorbent such as, for example, activated carbon and/or a microporous zeolite sorbent to remove gas phase components from smoke. The microporous sorbent can have pores with widths or diameters of less than about 20 Å. While any suitable material can be used as a microporous sorbent, preferred embodiments include activated carbon sorbents. Also, while various flavors can be used, menthol is a preferred flavor to be added to tobacco smoke during smoking of cigarettes. In an alternative exemplary embodiment, a flavored smoking article can be free of a microporous sorbent such as activated carbon and/or a catalyst material and the mesoporous molecular sieve can be adapted to release flavor as well as remove gas phase components such as aldehydes from smoke. Preferably at least some if not all of the mesoporous sieve material is flavor-bearing or otherwise impregnated with a flavor.

The mesoporous molecular sieve material is preferably in particle form when used as a component of a filter of a cigarette. For example, the mesoporous flavor carrier can be formed into agglomerates in combination with a binder suitable to form a spherical or granular shape with a diameter of from about 0.3 mm to about 0.85 mm or 20 to 50 mesh size to facilitate processing into cigarette filters so as to achieve adequate attribution, low dust generation and filter pressure drop (resistance to draw). For example, powder of a mesoporous sorbent such as silicate or aluminosilicate can be mixed with powder of a binder such as aluminum hydroxide (e.g., alumina boehmite in a ratio of from about 0.1:1 to 1:0.1 sorbent to binder and the mixture can be made into a paste by addition of a weak HCl solution. The paste can be mixed in a high speed granulation process to form spherical/granular particles of suitable sizes and then dried at 50 to 150° C. in air. To remove volatiles, the dried particles can be calcined in air at 300 to 700° C.

To incorporate a flavor such as menthol, liquid flavorant (e.g., a flavorant dissolved in a suitable solvent) can be mixed with the calcined particles, e.g., an amount of menthol crystals to be added to the mesoporous silica can be melted and mixed with the freshly calcined particles. A flavorant may be incorporated into a mesoporous flavor carrier by spraying flavorant on a batch of mesoporous sieve particles in a mixing (tumbling) drum or alternatively in a fluidized bed using, for example, nitrogen gas as the fluidizing agent.

Various filter constructions known in the art can be used, in which a flavor carrier can be incorporated. Exemplary filter structures that can be used include, but are not limited to, a mono filter, a dual filter, a triple filter, a single or multi cavity filter, a recessed filter, a free-flow filter, combinations thereof and the like. Mono filters typically contain cellulose acetate tow or cellulose paper materials. Dual filters typically comprise a mouthpiece filter plug of cellulose acetate and a second, usually different, filter plug (or segment). The length and pressure drop of the segments in a dual filter can be adjusted to provide optimal sorption, while maintaining acceptable draw resistance. Triple filters can include mouth and smoking material or tobacco side segments, and a middle segment comprising paper or other filter segment. Cavity filters include two segments, e.g., acetate-acetate, acetate-paper or paper-paper, separated by at least one cavity. Recessed filters include an open cavity on the mouth side. The filters can also be ventilated and/or comprise additional sorbents (such as charcoal or magnesium) catalysts or other additives suitable for use in the cigarette filter.

A filter region of an exemplary embodiment of a smoking article (e.g., a cigarette), can be constructed so that a microporous sorbent, such as, for example, an activated carbon is located in a cavity at least about 5 mm to about 6 mm from a tobacco portion (e.g., tobacco rod) of the article. In a dual cavity filter, the flavor releasably disposed in a mesoporous sieve can be located in a second section or portion of the filter downstream of the sorbent with a section of cellulose acetate ranging between about 5 mm and about 6 mm in length in between the two cavities.

While a preferred filter includes a microporous sorbent and a flavor carrier, the flavor carrier can also be used in smoking articles without a microporous sorbent in the filter. Regardless of the type of article in which the flavor carrier is incorporated, the flavor carrier provides effective containment and delivery of volatile flavors.

Figure 1A:
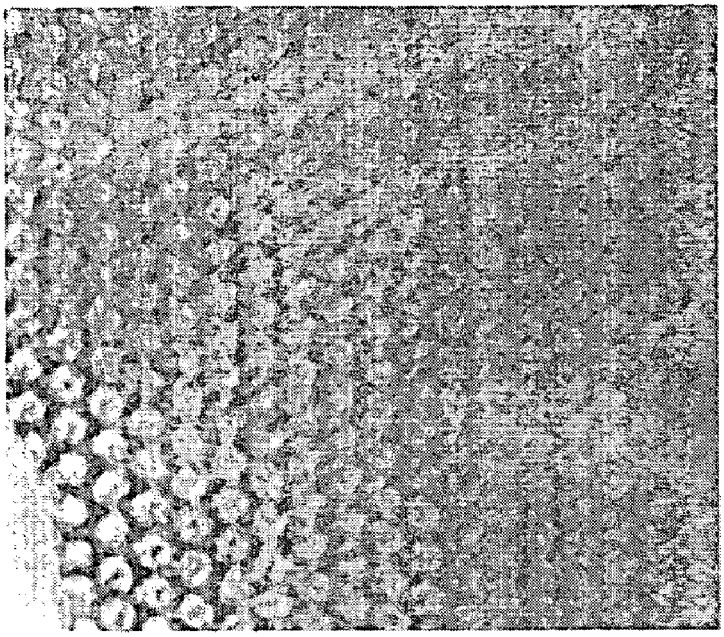
Figure 1B:
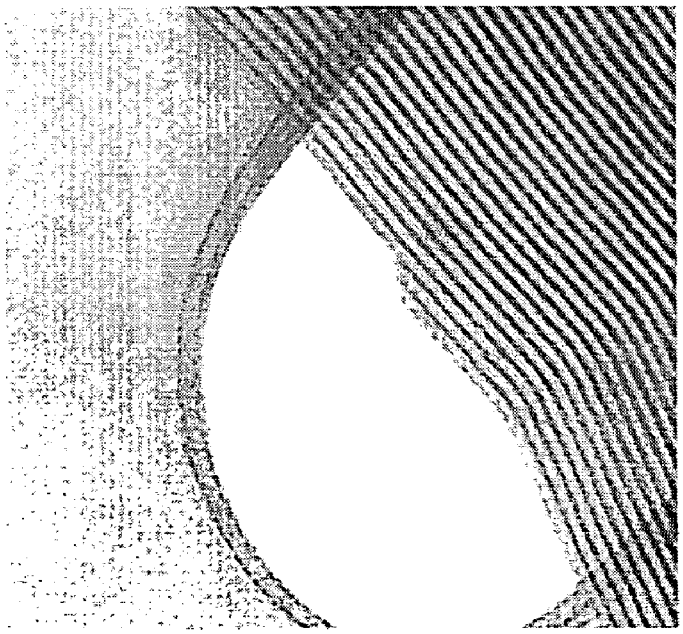

A preferred flavor carrier comprises a mesoporous material impregnated with menthol. A photograph taken along (FIG. 1A) and perpendicular to (FIG. 1B) the pore axis of a preferred mesoporous material (SBA-15) suitable for storing menthol flavor is depicted in FIG. 1. The mesoporous material shown in FIG. 1 is SBA-15 silica having a uniform (~55 Å) pore size with a pore volume of about 1 $m^2/g$.

Figure 2:
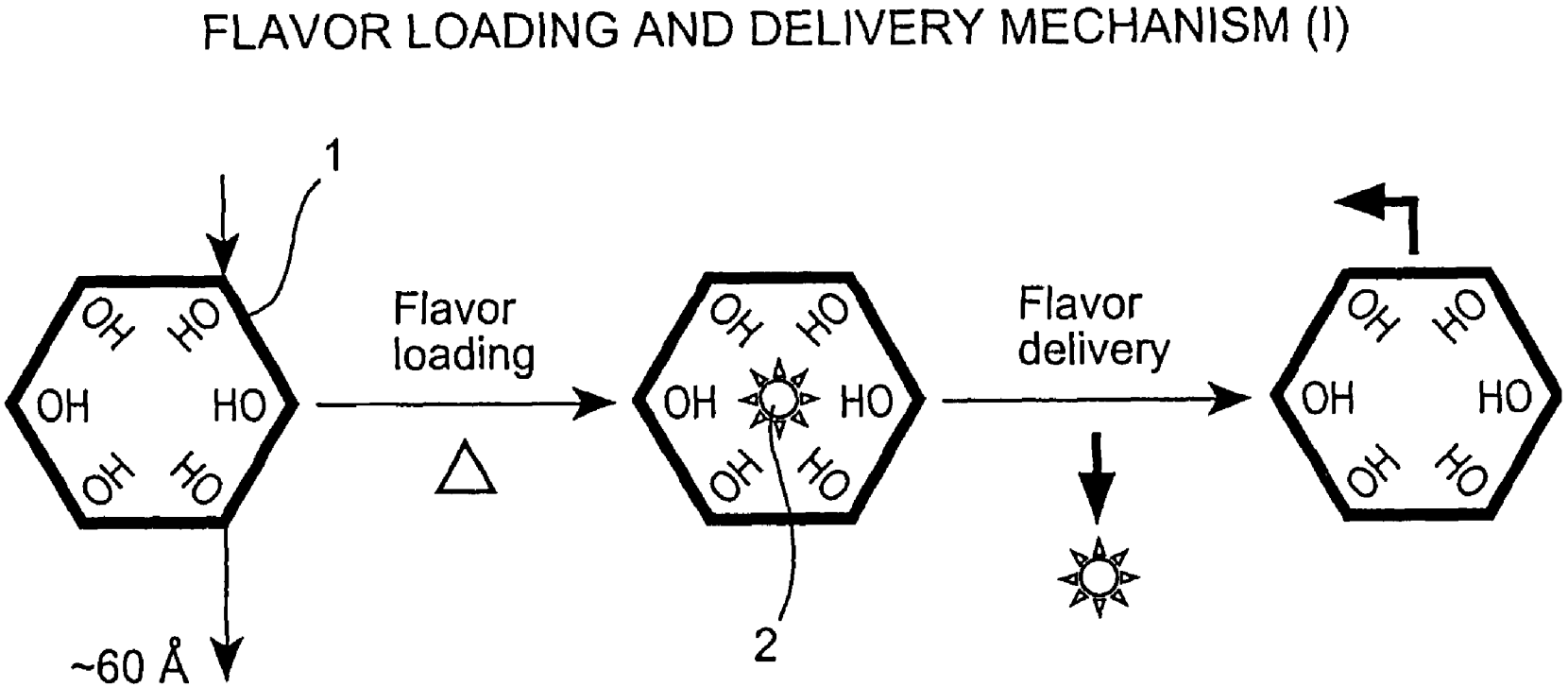
FIG. 2 is a schematic of an exemplary flavor loading and delivery mechanism.

An exemplary embodiment of a flavor loading and delivery mechanism is depicted in FIG. 2. In the mechanism depicted in FIG. 2, a mesoporous molecular sieve 1 suitable for storing menthol flavor is provided that has pores with a diameter of about 50 to 60 Å. A menthol flavor 2 is releasably disposed within the mesoporous molecular sieve. Upon contact with a gas stream such as, for example, tobacco smoke from a smoking article, the flavor 2 is released from the sieve 1.

Figure 3:
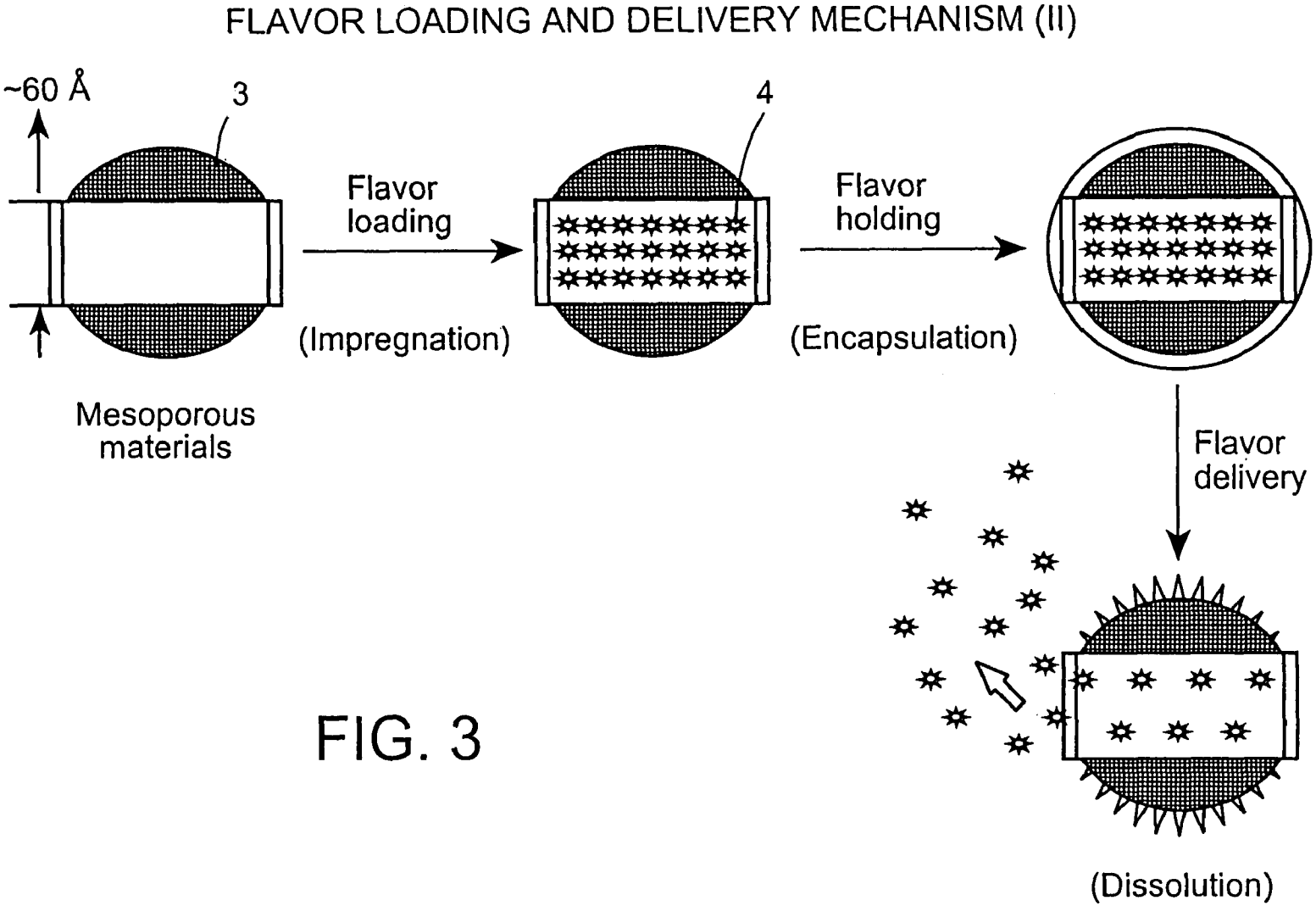
FIG. 3 is a schematic of an exemplary flavor loading and delivery mechanism.

Another exemplary embodiment of a menthol flavor loading and delivery mechanism is depicted in FIG. 3. In this mechanism, a mesoporous sieve 3 is provided having pores with a diameter of about 50 to 60 Å. Flavor loading is conducted so that a menthol flavor 4 is releasably disposed within the sieve 3. Optionally, the flavor 4 is substantially encapsulated or sealed within the pores of the mesoporous molecular sieve with a water-soluble encapsulating material or sealer, such as, for example, a sugar. "Substantially encapsulated or sealed" means that the flavor 4 is sufficiently contained in the pores of the sieve 3 to substantially eliminate migration during non-use (e.g., during room temperature storage). Substantial encapsulation or sealing does not necessarily mean that the flavor 4 is completely encapsulated or sealed within the pores of the sieve 3. However, it is believed that complete encapsulation of a flavor can further reduce the migration of a flavor before smoking (e.g., eliminate migration) as compared with a non-encapsulated flavor. Upon exposure to moisture, such as water vapor present in a gas stream such as, for example, smoke drawn through a smoking article, the water-soluble material or sealer dissolves so that the encapsulated or sealed flavor 4 can be released into the tobacco smoke.

In a preferred embodiment, a flavor carrier can be incorporated into a variety of products including, for example, a variety of smoking articles. The flavor carrier can be incorporated in a hollow portion of a cigarette filter. For example, some cigarette filters have a plug/space/plug configuration in which the plugs comprise a fibrous filter material such as cellulose acetate and the space is simply a void between the two filter plugs. That void can be filled with mesoporous molecular sieve having a flavorant releasably disposed within the sieve. Other locations for the flavor carrier include incorporation in filter components such as paper and or fibrous materials used in the cigarette filter.

Figure 4:
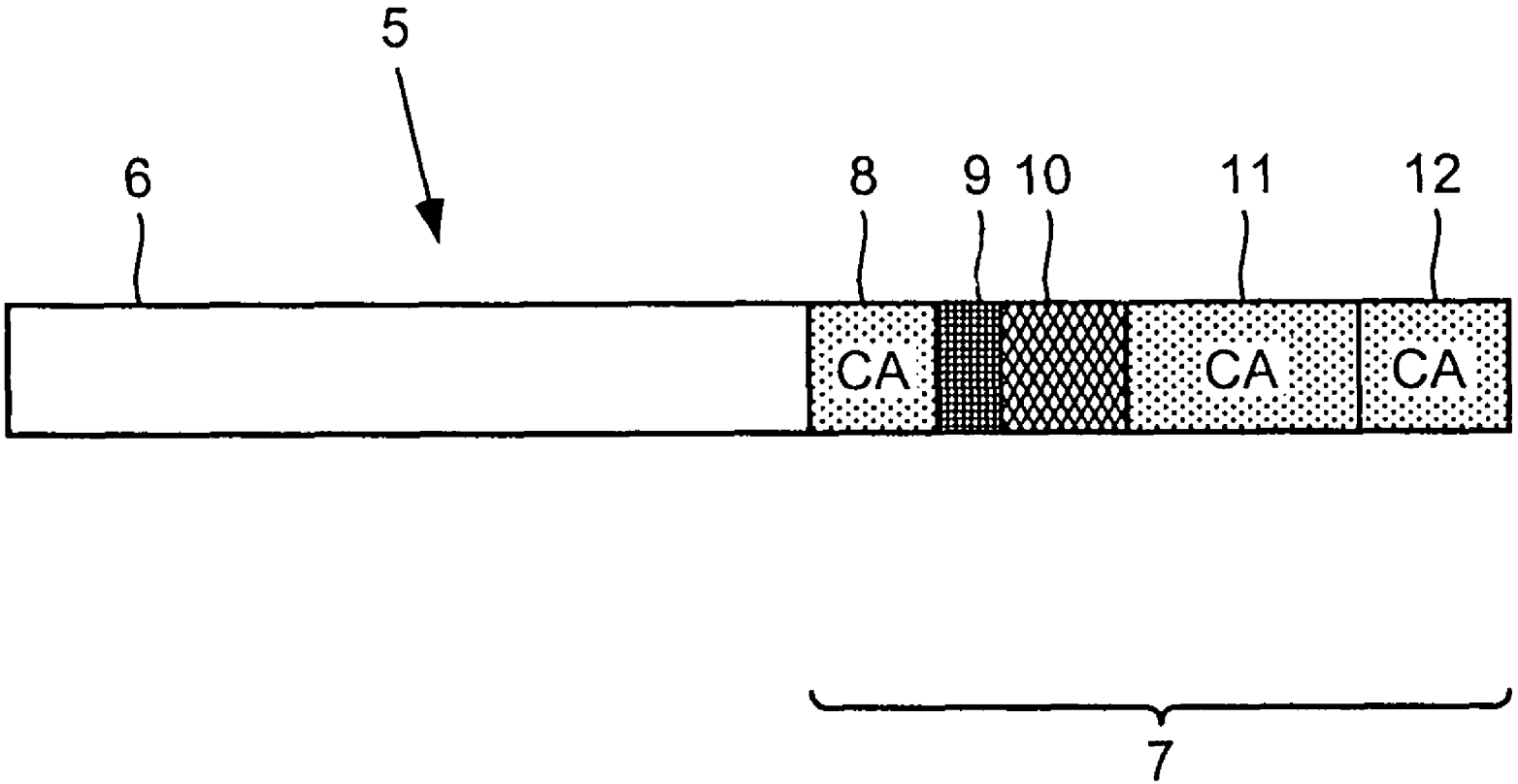
FIG. 4 is another schematic of an exemplary embodiment of a smoking article.

An exemplary embodiment of a smoking article is depicted in FIG. 4. The article 5 depicted in FIG. 4 (prototype A) is a cigarette that includes a tobacco portion 6 such as, for example, a tobacco rod. The article also includes a filter portion 7. The filter portion 7 is positioned relative to the tobacco portion 6 so that a section of the filter portion 7 closest to the tobacco portion 6 is a section of cellulose acetate (CA) 8. The section of CA 8 is about 6 mm in length. The filter portion 7 includes a sorbent 9. The sorbent 9 includes about 75 mg of activated carbon, such as beaded activated carbon having a diameter of about 0.35 mm. The section of sorbent 9 is about 4 mm length. The filter portion 7 includes a flavor carrier 10 downstream of the sorbent. The flavor carrier 10 includes about 80 mg of non-encapsulated mentholated mesoporous silica particles sized being between about 20 mesh and 50 mesh and having a menthol/silica/alumina ratio of about 0.88 to about 1 to about 0.75. The flavor carrier segment 10 is about 6 mm in length. The filter portion 7 includes a downstream second section of CA 11 being about 11 mm in length and a third section of CA 12 being about 8 mm in length. In total, the filter portion 7 of the article 5 is about 34 mm in length.

Figure 5:
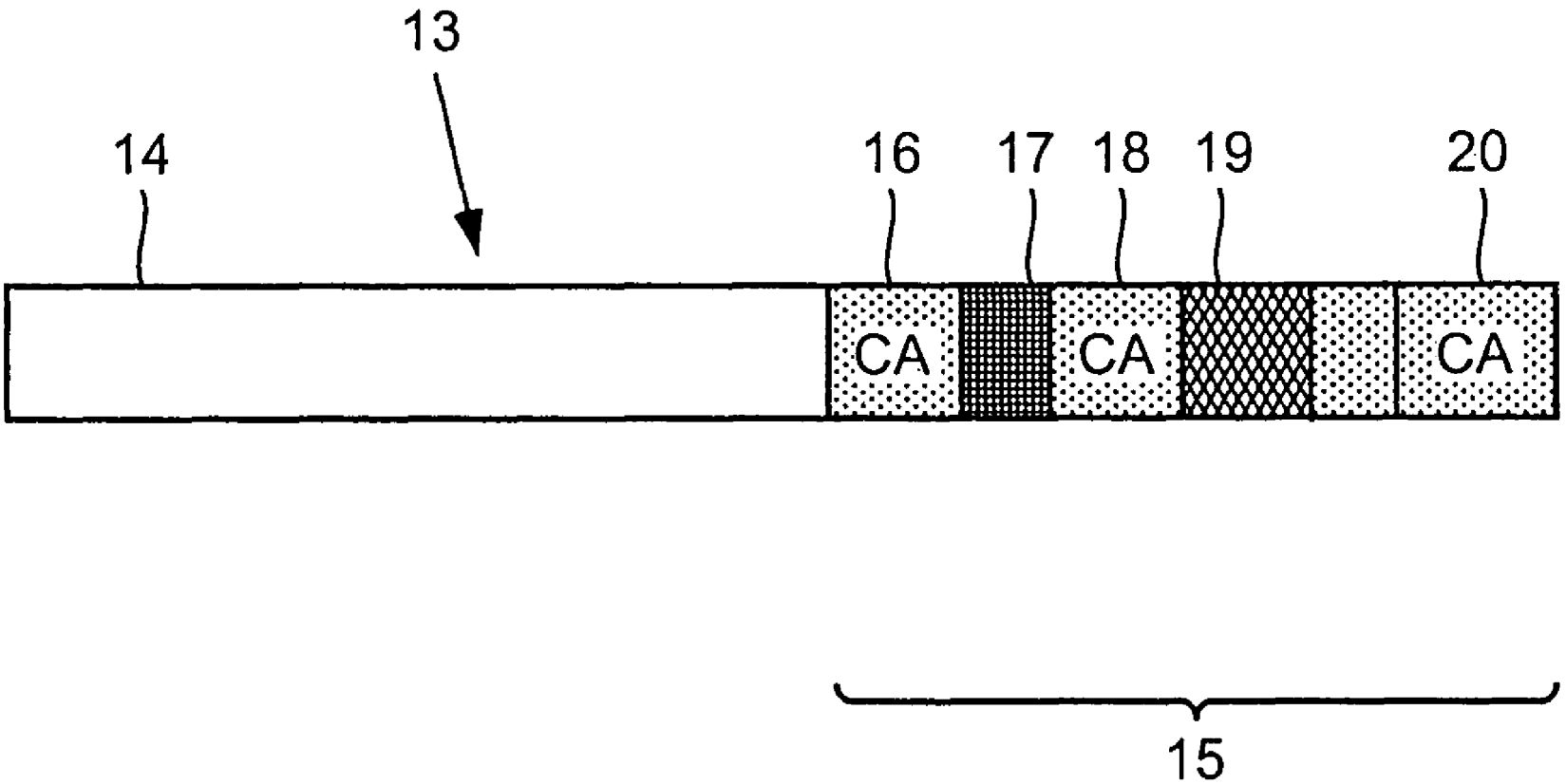
FIG. 5 is another schematic of an exemplary embodiment of a smoking article.

Another exemplary embodiment of a smoking article is depicted in FIG. 5. The article 13 depicted in FIG. 5 (prototype B) is a cigarette which includes a tobacco portion 14 such as, for example, a tobacco rod. The article also includes a filter portion 15. The filter portion 15 is positioned relative to the tobacco portion 14 so that a first CA section 16 is positioned adjacent to the tobacco portion 14. The CA section 16 is about 6 mm in length. The filter portion 15 also includes a sorbent 17 comprising about 95 mg of activated carbon, such as beads having a diameter of about 0.35 mm. The sorbent 17 is about 4 mm in length. The filter portion 15 includes a second CA section 18 being about 6 mm in length. The filter section 15 then includes a flavor carrier 19 including about 80 mg of non-encapsulated mentholated mesoporous silica having a pore size of about 20 mesh to about 50 mesh. The mentholated mesoporous silica in the flavor carrier 19 also has a menthol/silica/alumina ratio of about 0.88 to about 1.00 to about 0.75. The flavor carrier 19 is about 6 mm in length. Finally, the filter portion 15 includes a third CA section 20, which is about 12 mm in length. In total, the filter portion 15 is about 34 mm in length.

Figure 6:
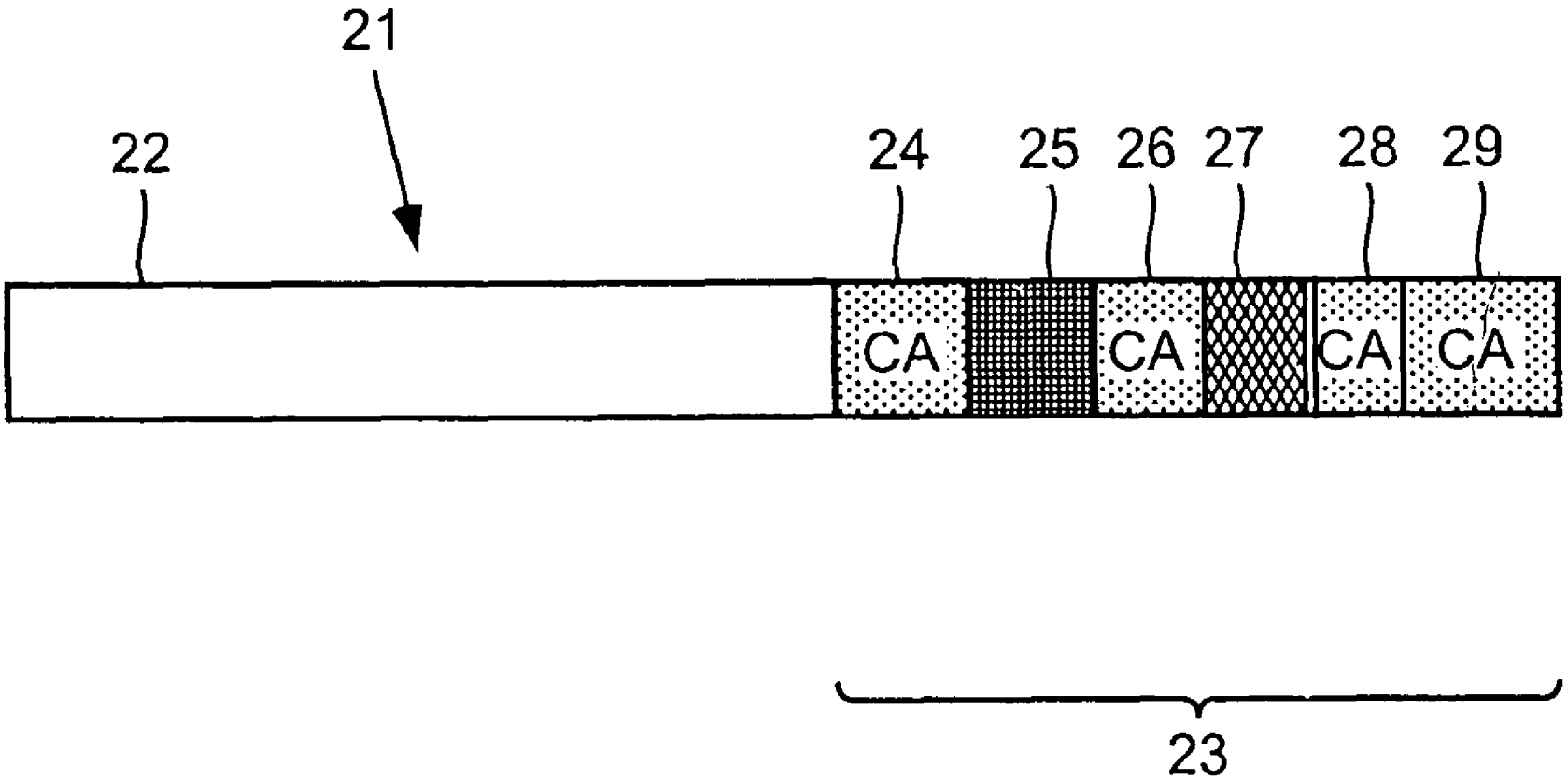
FIG. 6 is another schematic of an exemplary embodiment of a smoking article.

Another exemplary embodiment of a smoking article is depicted in FIG. 6. The article 21 depicted in FIG. 6 (prototype C) is a cigarette which includes a tobacco portion 22 such as, for example, a tobacco rod. The article 21 also includes a filter portion 23. The filter portion 23 first includes a CA section 24 adjacent to the tobacco section 22. The CA section 24 is about 6 mm in length. The filter portion 23 includes a sorbent 25 comprising about 150 mg of activated carbon beads having a diameter of about 0.35 mm. The sorbent 25 is about 6 mm in length. The filter 23 includes a second CA section 26. The CA section 26 is about 5 mm in length. The filter portion 23 includes a flavor carrier 27 comprising about 110 mg of non-encapsulated mentholated mesoporous silica having a pore size of about 20 mesh to 50 mesh and a menthol/silica/alumina ratio of about 0.22 to about 1.00 to about 0.75. The filter portion includes a third CA section 28, being about 4 mm in length, and a fourth CA section 29, being about 8 mm in length. In total, the filter portion 23 is about 34 mm in length.

Figure 7:
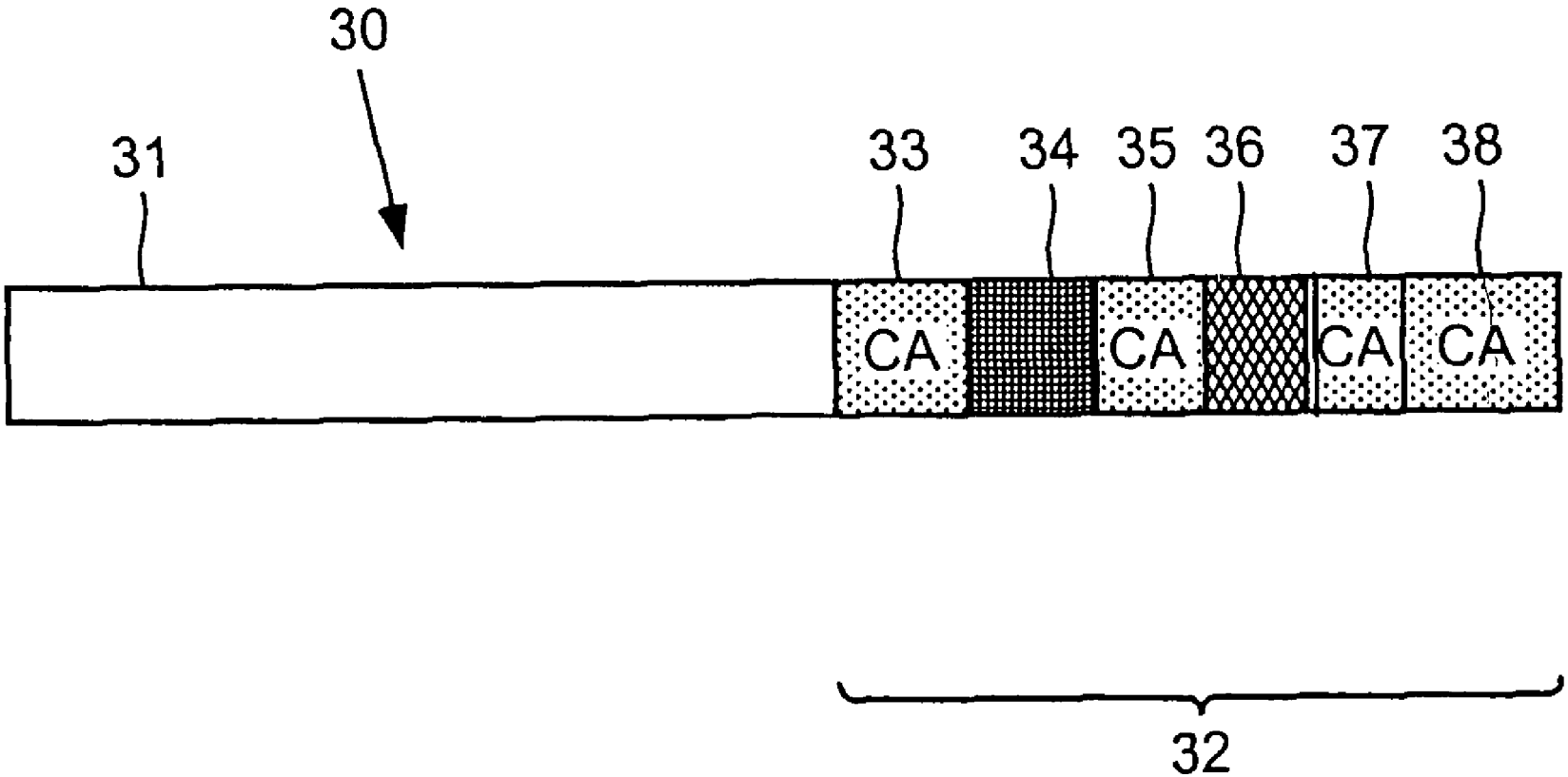
FIG. 7 is another schematic of an exemplary embodiment of a smoking article.

Yet another exemplary embodiment of a smoking article is depicted in FIG. 7 (prototype D). The article 30 is a cigarette which includes a tobacco portion 31 such as, for example, a tobacco rod. The article 30 also includes a filter portion 32. The filter portion 32 includes a first CA section 33 being about 6 mm in length. The filter portion 32 includes a sorbent 34 comprising about 150 mg of activated carbon, such as beads having a diameter of about 0.35 mm. The sorbent 34 is about 6 mm in length. The filter portion 32 includes a second CA section 35 being about 5 mm in length. The filter portion 32 then includes a flavor carrier 36 comprising about 110 mg of non-encapsulated mentholated mesoporous silica having a pore size of about 20 mesh to about 50 mesh and a menthol/silica/alumina ratio of about 0.44 to about 1.00 to about 0.75. The filter portion 32 includes a third CA section 37 and a fourth CA section 38, the third CA section 37 being about 4 mm in length and the fourth CA section 39 being about 8 mm in length. In total, the filter portion 32 is about 34 mm in length.

As mentioned above, filters may have a plug/space/plug configuration wherein the plugs comprise a fibrous filter material. In addition to, or in lieu of, incorporating the mesoporous molecular sieves into the space between the plugs, the sieves can be incorporated in and/or on the filter material that makes up one or more plugs. For example, the sieves can be incorporated in various ways such as by being loaded onto paper or other substrate material that is fitted into the passageway (e.g., space) of a filter element. They may also be deployed as a liner in the interior of the filter element. Alternatively, the mesoporous molecular sieves can be incorporated into the fibrous wall portions of the filter element. For instance, a tubular free-flow filter element or sleeve can be made of suitable materials such as polypropylene or cellulose acetate fibers and the mesoporous molecular sieves can be mixed with such fibers prior to or as part of the sleeve forming process.

In another embodiment, a mesoporous molecular sieve having a flavor releasably disposed therein is incorporated into cellulose acetate tow and the cellulose acetate tow is, in turn, incorporated into a smoking article at any location that is exposed to the smoke stream, such as a plug.

The fibrous filter material can comprise a micro-cavity fiber such as a multilobal (e.g, trilobal or quadrilobal) micro-cavity fiber as described in U.S. Pat. No. 5,057,368 and commonly-assigned U.S. Pat. No. 6,584,979, the contents of which are incorporated herein by reference in their entirety. These fibers are capable of mechanically or electrostatically entrapping fine particles of the flavor carrier within the micro-cavity channels of the fiber.

Micro-cavity fibers used to support a flavor-containing mesoporous molecular sieve may be constructed from any material suitable for cigarette use. For example, the micro-cavity fibers may be polypropylene or cellulose acetate fibers. The molecular sieve can be uniformly distributed in the cigarette filter to interact with the smoke stream without substantially interfering with the gas flow rate (resistance-to-draw or RDT) through the filter. By controlling the density and distribution of the loaded fibers, an effective gas filter/flavor releasing filter component can be formed.

Various techniques can be used to apply the mesoporous molecular sieve to filter fibers (e.g., micro-cavity fibers and/or conventional fibers). For example, the molecular sieve can be added to the filter fibers before they are formed into a filter rod, or added to the filter fibers, for example, in the form of a dry powder or slurry. If applied in the form of slurry, the fibers are preferably allowed to dry before they are incorporated into a filter rod. The molecular sieves are held in the micro cavities of the fibers via mechanical and/or electrostatic interaction, thereby minimizing exposure to binders or plasticizers used in cigarette filter fabrication.

According to an embodiment, mesoporous molecular sieves provided with a flavor releasably disposed therein are incorporated into the cellulose acetate that comprises one or more plug portions of a filter element. The flavor-impregnated sieves can be incorporated into the cellulose acetate before, during and/or after the cellulose acetate is formed into a filter component (e.g., plug). Thus, filter fiber material such as cellulose acetate that has been impregnated with flavor-bearing mesoporous molecular sieves can be added to or be substituted in place of conventional filter fibers (e.g., sieve-free cellulose acetate fibers) in a filter plug.

A filter comprising fiber-supported molecular sieves that are impregnated with a flavorant can optionally further include a cavity containing particles of a microporous sorbent material or a monolithic segment of such material. The microporous sorbent can be a bed of sorbent material as described above. Alternatively the microporous sorbent can be incorporated in and/or on a fibrous support. The microporous sorbent, if included, can be located in a filter cavity or segment axially adjacent to the flavorant or preferably separated from the flavorant by a space or plug such as a cellulose acetate plug. The microporous sorbent can be positioned upstream and/or downstream from the fiber-supported mesoporous molecular sieves. Preferably the molecular sieves are located downstream from the microporous sorbent so that flavor released from the molecular sieves is not removed from the gas stream by the microporous sorbent.

In a preferred embodiment, a method of making a filter portion of a smoking article comprises incorporating a flavor carrier into a filter portion of a smoking article, wherein the flavor carrier comprises a mesoporous molecular sieve having a flavor releasably disposed therein. In exemplary embodiments, the mesoporous molecular sieve has a plurality of pores uniformly distributed over the surface and throughout the volume of the sieve, wherein the pores are between about 20 Å and about 300 Å in size. In addition, the sieve can have a surface area of 500 to 3000 $m^2/g$ and a pore volume of 0.5 to 3 $cm^3/g$.

An exemplary embodiment of a method of making smoking articles comprises providing a cut filler to a cigarette-making machine to form a tobacco portion (e.g., a tobacco column); placing a paper wrapper around the tobacco column to form a tobacco rod; and attaching a filter portion comprising a flavor carrier to the tobacco rod to form the smoking article.

Examples of suitable types of tobacco materials that can be used include, but are not limited to, flue-cured tobacco, Burley tobacco, Maryland tobacco, Oriental tobacco, rare tobacco, specialty tobacco, blends thereof and the like. The tobacco material can be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. Tobacco substitutes can also be used.

In cigarette manufacture, the tobacco is normally used in the form of cut filler, i.e., in the form of shreds or strands cut into widths ranging from about 1/10 inch to about 1/20 inch or even about 1/40 inch. The lengths of the strands range from between about 0.25 inch to about 3.0 inches. The cigarettes can further comprise tobacco or wrapper additives (e.g., burn additives, combustion modifying agents, coloring agents, binders, taste modifiers, etc.).

Techniques for cigarette manufacture are known in the art, and can be used to incorporate a flavor carrier in the filter portion of a cigarette. Such cigarettes can be manufactured to any desired specification using standard or modified cigarette-making techniques and equipment. The cigarettes can have a length ranging from about 50 mm to about 120 mm. The circumference of a cigarette is generally between about 15 mm and about 30 mm, and is preferably about 25 mm. The packing density is typically between about 100 $mg/cm^3$ and about 300 $mg/cm^3$, and preferably about 150 $mg/cm^3$ to about 270 $mg/cm^3$.

In a preferred embodiment, a method of smoking includes heating or lighting a smoking article to produce smoke and drawing the smoke through the smoking article. During smoking of the article, the flavor releasably disposed within the mesoporous molecular sieve of the flavor carrier is released to impart a flavor to the smoke drawn through the cigarette.

"Smoking" of a cigarette (or smoking article) means the heating or combustion of the cigarette to form tobacco smoke. Generally, smoking of a cigarette involves lighting one end of the cigarette and drawing the smoke through the mouth end of the cigarette, while the tobacco contained therein undergoes a combustion reaction. However, the cigarette can also be smoked by other means. For example, the cigarette can be smoked by heating the cigarette using an electrical heater, as described, for example, in commonly-assigned U.S. Pat. No. 6,053,176; 5,934,289; 5,591,361 or 5,322,075, each of which is incorporated herein by reference in its entirety.

EXAMPLE

An assessment of a porous material for use as a flavor carrier in a smoking article is conducted in terms of the material's pore structure. It is determined that flavor delivery is related to an internal diffusion process driven by pressure drop $\Delta P$. Quantification of the deviation in equilibrium vapor pressure between confined and unconfined flavorant is determined via Kelvin's equation as defined above.

Figure 8:
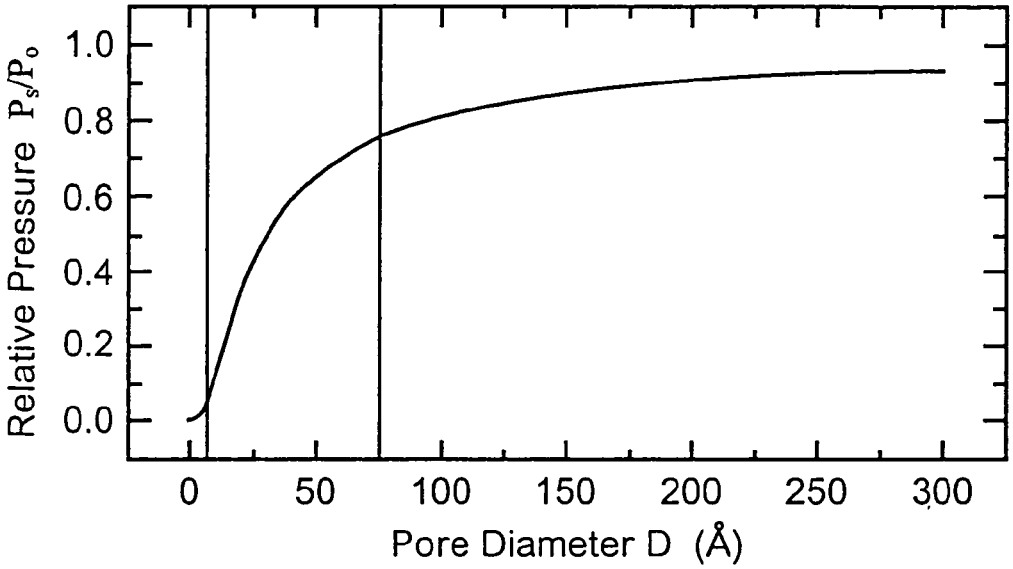
FIG. 8 is a graph showing dependence of saturation pressure on pore diameter.

A theoretical analysis is conducted to determine relative pressure $P_s/P_o$ versus pore diameter (D) in Å to assess the dependence of saturation pressure ($P_s$) on the porous material's pore diameter (D). The theoretical analysis is conducted using water at a temperature (T) of about 293 K, wherein $\gamma$=about 72.75 mN $m^{-1}$; $\theta=0°$, $V_m$=18.03 $cm^3$ $mol^{-1}$; and R=8.314 J $mol^{-1}$ $K^{-1}$. The analysis generates the data depicted in FIG. 8. From the model, relative pressure as a function of pore diameter can be expressed at $P_s/P_o=\exp(-21.54D)$. However, strong adsorption due to chemical and/ or polar interaction between the flavor compound and the molecular sieve material, which are not considered in the analysis, can adversely affect flavor delivery.

Figure 9:
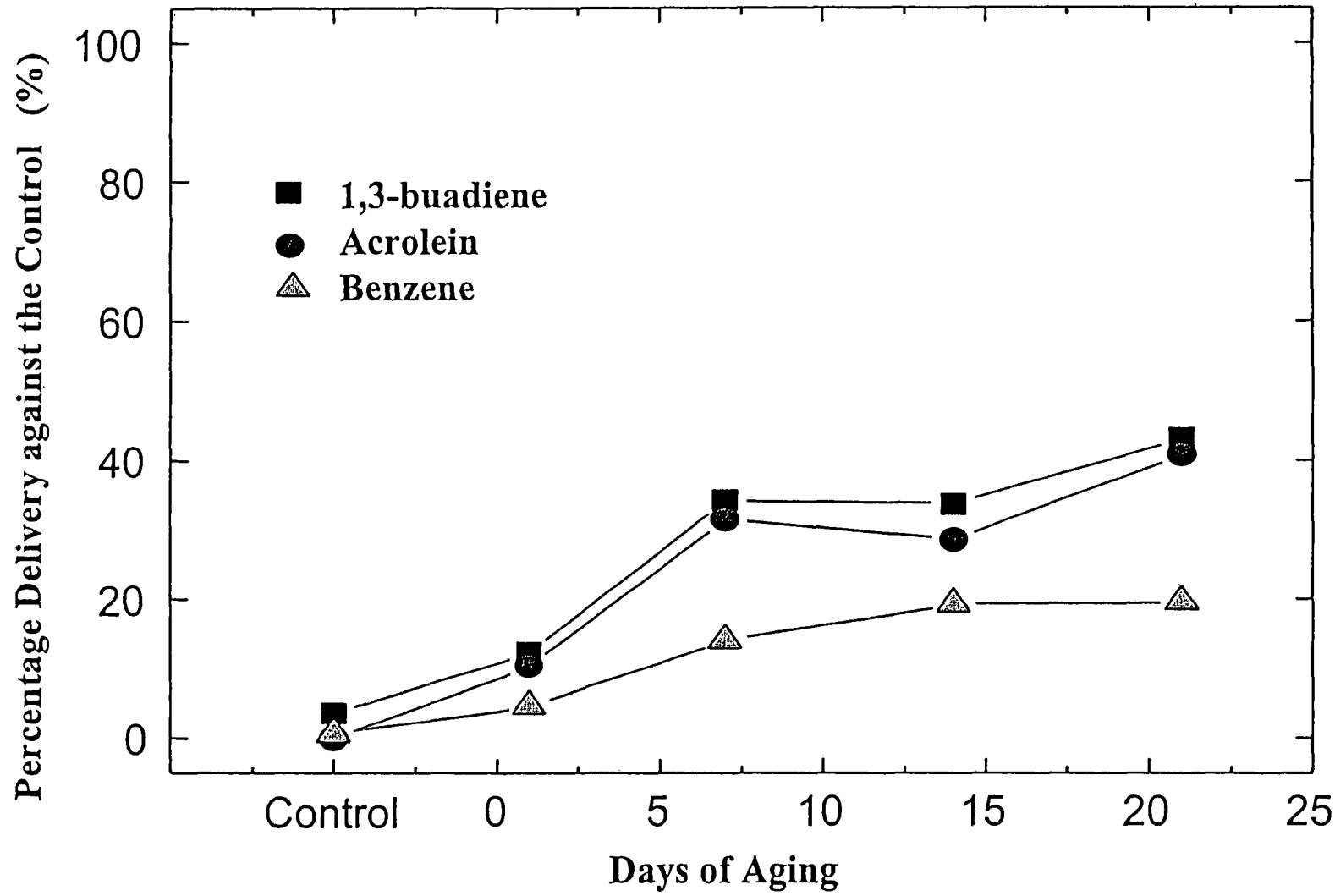
FIG. 9 is a graph of % delivery of 1,3-butadiene, aerolein and benzene versus time (in days) for a prototype A cigarette having 75 mg activated carbon beads 0.35 mm in size upstream of 80 mg of menthol flavored mesoporous silica having a ratio of menthol:silica:alumina of 0.88:1.00:0.75.

FIG. 9 shows an aging study wherein % delivery of 1,3-butadiene, acrolein and benzene is measured over 20 days for prototype A cigarettes compared to a control cigarette. The prototype A cigarette included a tobacco rod, 6 mm plug of cellulose acetate (CA), 4 mm cavity containing 0.35 mm diameter carbon beads (75 mg), 6 mm cavity containing 20 to 50 mesh mentholated mesoporous silica (80 mg SBA-15), 11 mm plug of cellulose acetate and an 8 mm plug of cellulose acetate, respectively. The mentholated mesoporous silica, which was not encapsulated, included a ratio of menthol: silica:alumina of 0.88:1:0.75. In the control cigarette the mentholated silica filter segment of prototype A is replaced with a cellulose acetate (CA) segment. The results show that prototype A exhibits some deactivation of the carbon sorbent over time. Such deactivation may be minimized by using higher amounts of carbon beads, encapsulation of the mentholated silica and/or separating the carbon beads from the mentholated silica with a filter segment such as a cellulose acetate plug. The effects of increasing the amount of carbon beads and of separating the carbon beads from the mentholated silica are illustrated by the aging studies for prototype B-D cigarettes, as shown below in FIGS. 10-14.

Figure 10:
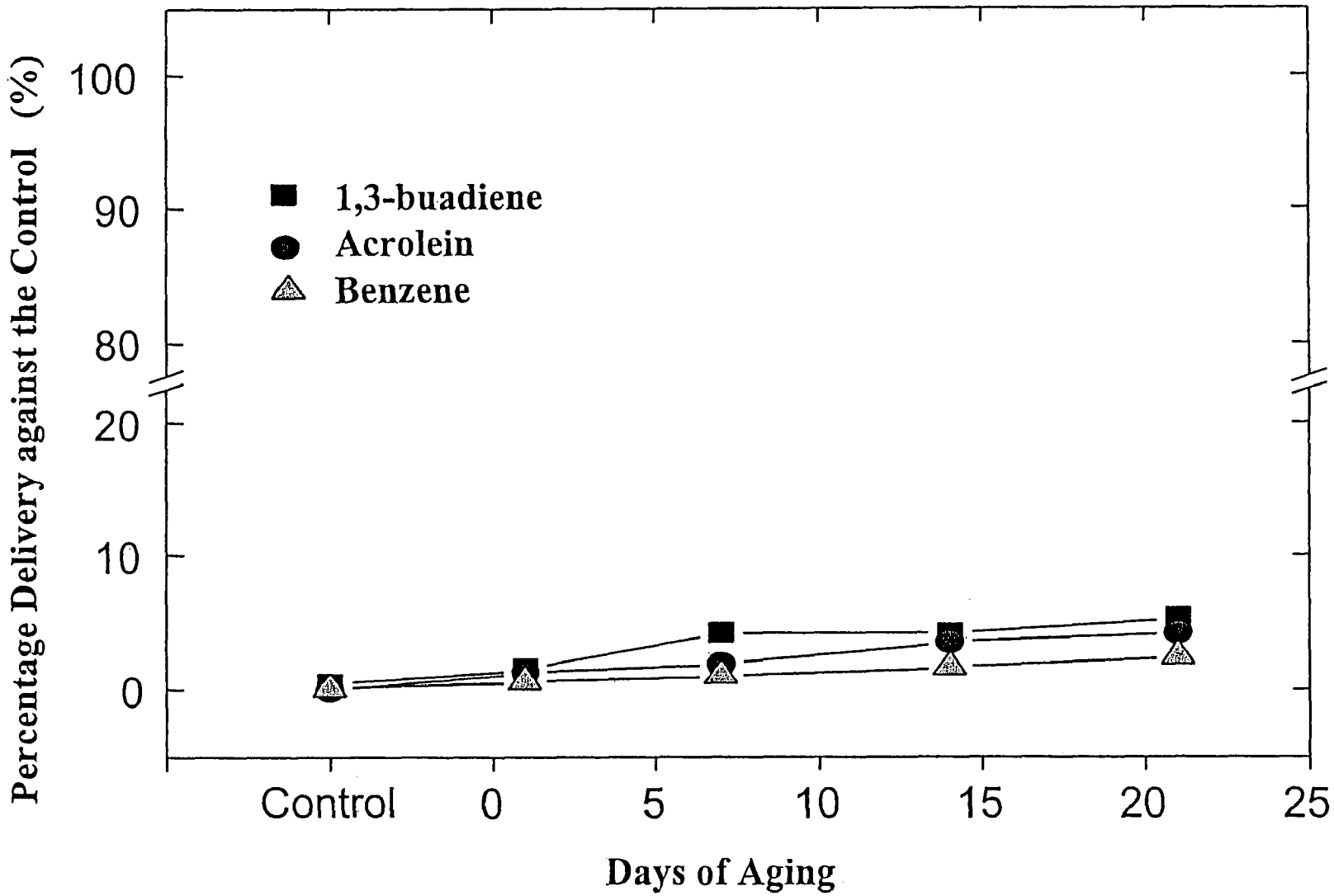
FIG. 10 is a graph of % delivery of 1,3-butadiene, aerolein and benzene versus time (in days) for a prototype B cigarette having 95 mg activated carbon beads 0.35 mm in size upstream of 80 mg of menthol flavored mesoporous silica having a ratio of menthol:silica:alumina of 0.88:1.00:0.75.

FIG. 10 shows an aging study wherein % delivery of 1,3-butadiene, acrolein and benzene is measured over 30 days for prototype B cigarettes compared to a control cigarette identical to the prototype cigarette except that the mentholated silica filter segment is replaced with a cellulose acetate (CA) segment. The prototype B cigarette included a tobacco rod, 6 mm plug of cellulose acetate, 4 mm cavity containing 0.35 mm carbon beads (95 mg), 6 mm plug of cellulose acetate, 6 mm cavity containing 20 to 50 mesh mentholated mesoporous silica (80 mg SBA-15), 4 mm plug of cellulose acetate and 8 mm plug of cellulose acetate, respectively. The mentholated mesoporous silica, which was not encapsulated, included a ratio of menthol:silica:alumina of 0.88:1:0.75. The results show that even after storing the cigarettes for 20 days, the menthol flavor was retained in the silica sufficiently such that the carbon beads were effective in reducing 1,3-butadiene, acrolein and benzene during smoking of the cigarette. Without wishing to be bound by theory, it is believed that by separating the mentholated mesoporous silica from the carbon beads with a cellulose acetate plug, deactivation of the carbon beads is reduced as compared with prototype A.

Figure 11:
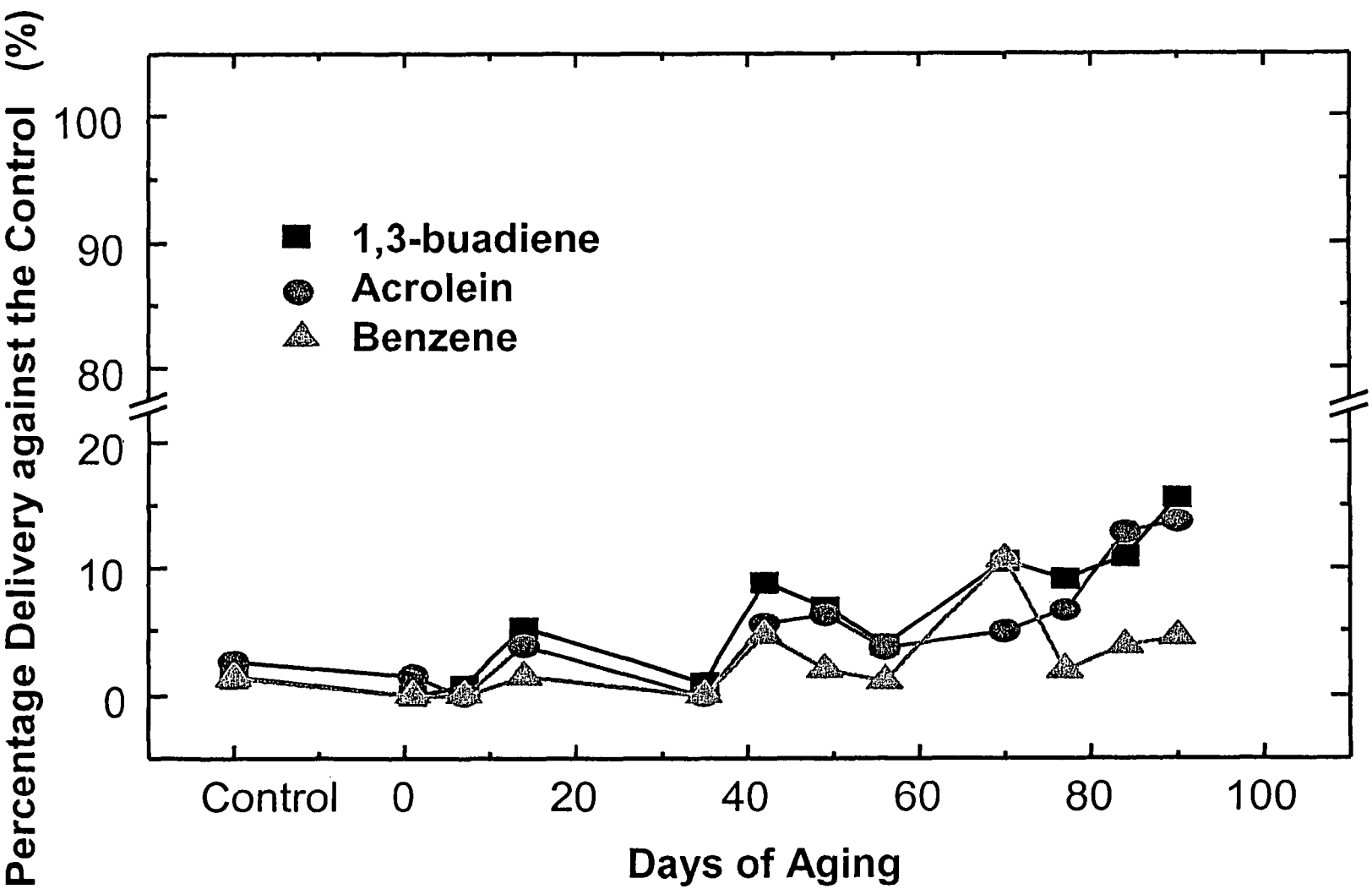
FIG. 11 is a graph of % delivery of 1,3-butadiene, aerolein and benzene versus time (in days) for a prototype C cigarette having 150 mg activated carbon beads 0.35 mm in size upstream of 110 mg of menthol flavored mesoporous silica having a ratio of menthol:silica:alumina of 0.22:1.00:0.75.

FIG. 11 shows an aging study wherein % delivery of 1,3-butadiene, acrolein and benzene is measured over 30 days for prototype C cigarettes compared to a control cigarette wherein the mentholated silica filter segment is replaced with a cellulose acetate (CA) segment. The prototype C cigarette included a tobacco rod, 6 mm plug of cellulose acetate, 6 mm cavity containing 0.35 mm carbon beads (150 mg), 5 mm plug of cellulose acetate, 5 mm segment containing 20 to 50 mesh mentholated mesoporous silica (110 mg SBA-15), 4 mm plug of cellulose acetate and 8 mm plug of cellulose acetate, respectively. The mentholated mesoporous silica, which was not encapsulated, included a ratio of menthol:silica:alumina of 0.22:1:0.75.

Figure 12:
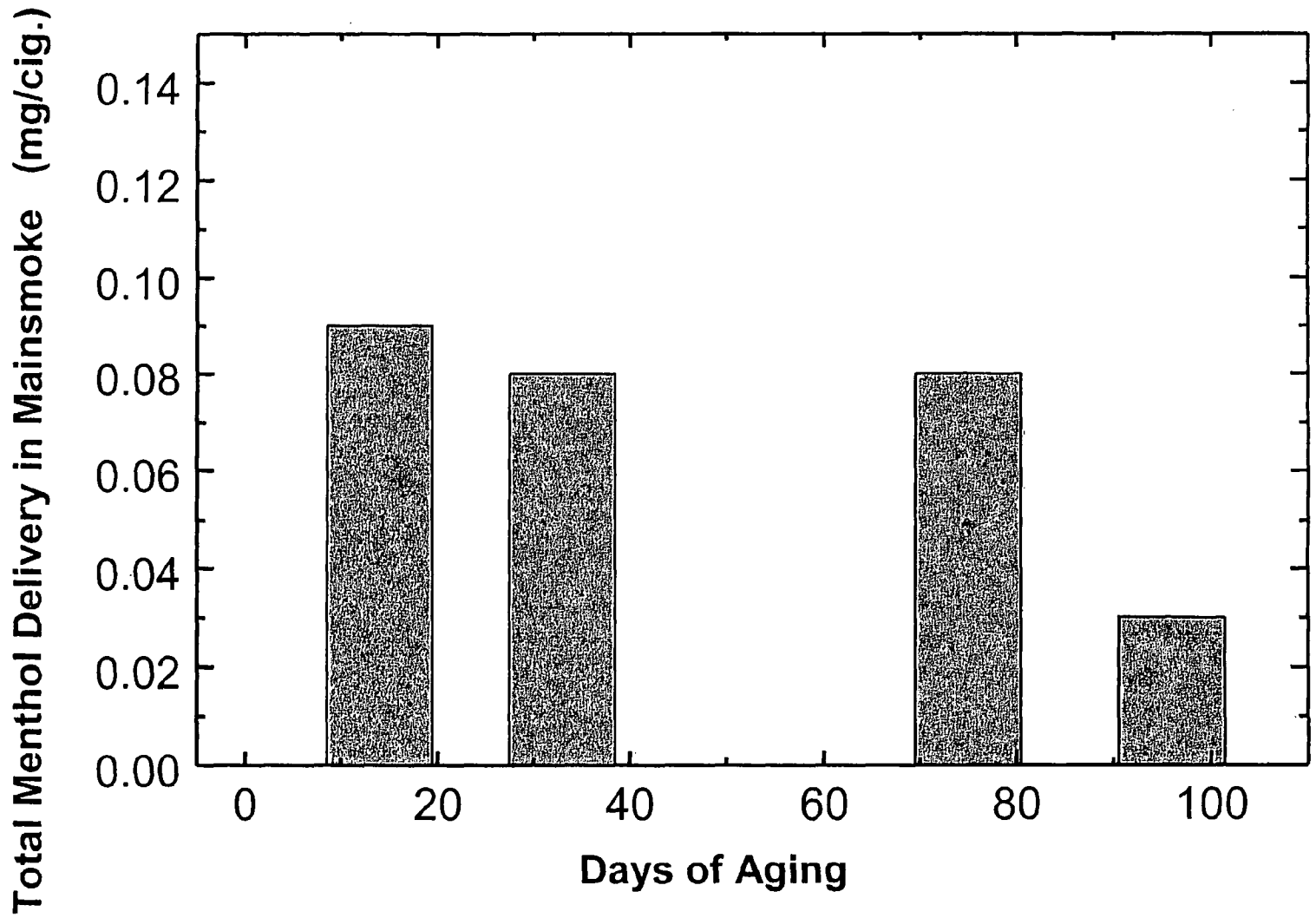
FIG. 12 is a graph of total menthol delivery versus time (in days) for a prototype C cigarette.

In FIG. 12, the total menthol delivery from the mentholated silica filter segment is shown as a function of time. After 70 days of storage the total menthol delivery is not substantially reduced. The aging results show that even after storing the cigarettes for 30 days, the menthol flavor was retained in the silica and/or the migration of menthol to the carbon beads was minimized sufficiently such that the carbon beads were effective in reducing 1,3-butadiene, acrolein and benzene during smoking of the cigarette. The results suggest that deactivation of the carbon beads can be minimized by separating the mentholated mesoporous silica from the carbon beads and/or by increasing the amount of carbon beads incorporated into the filter.

Figure 13:
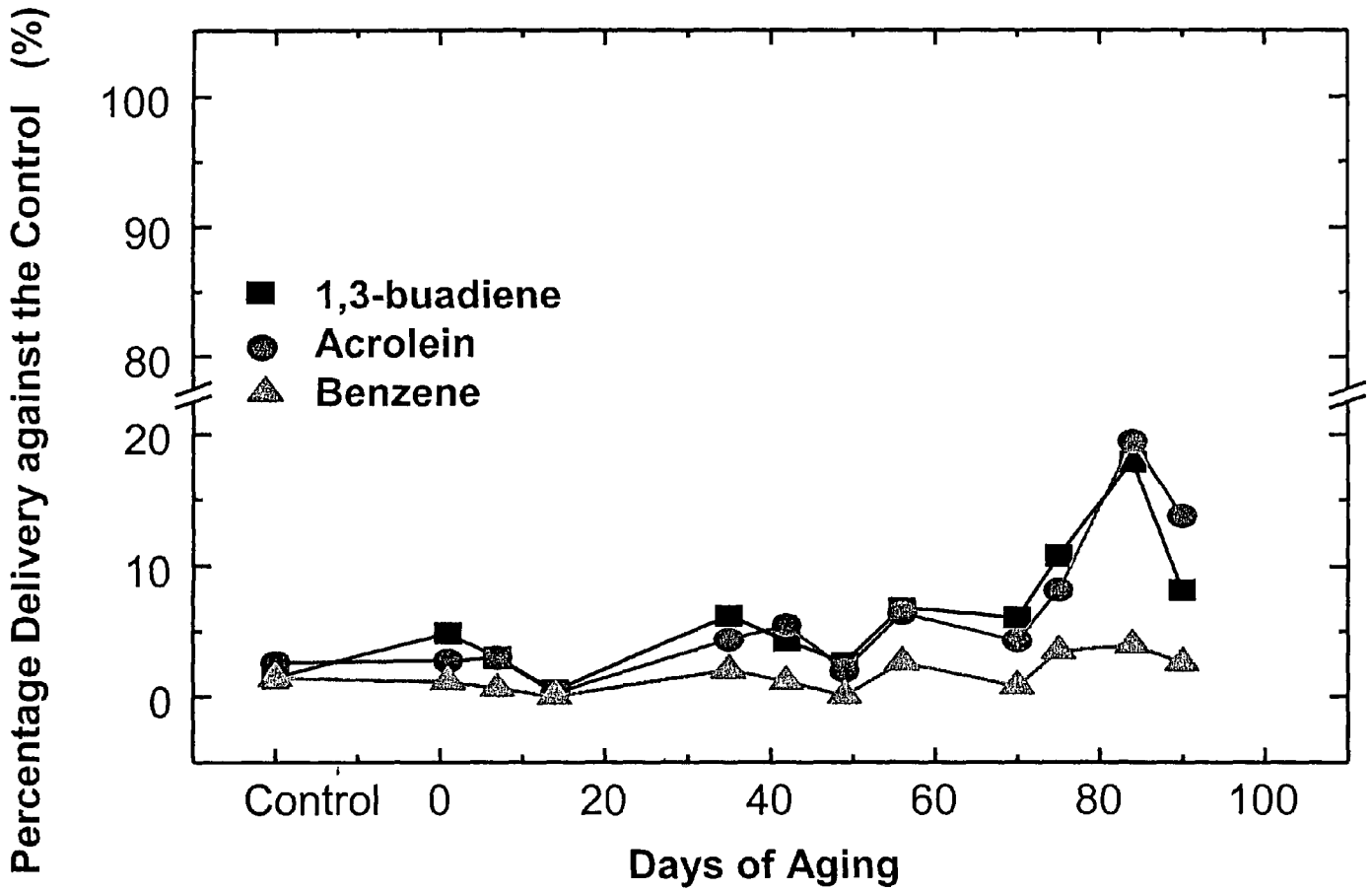
FIG. 13 is a graph of % delivery of 1,3-butadiene, aerolein and benzene versus time (in days) for a prototype D cigarette having 150 mg activated carbon beads 0.35 mm in size upstream of 110 mg of menthol flavored mesoporous silica having a ratio of menthol:silica:alumina of 0.44:1.00:0.75.

FIG. 13 shows an aging study wherein % delivery of 1,3-butadiene, acrolein and benzene is measured over 30 days for prototype D cigarettes compared to a control cigarette wherein the mentholated silica filter segment is replaced with a cellulose acetrate (CA) segment. The prototype D cigarette included a tobacco rod, 6 mm plug of cellulose acetate, 6 mm segment containing 0.35 mm carbon beads (150 mg), 5 mm plug of cellulose acetate, 5 mm segment containing 20 to 50 mesh mentholated mesoporous silica (110 mg SBA-15), 4 mm plug of cellulose acetate and 8 mm plug of cellulose acetate, respectively. The mentholated mesoporous silica, which was not encapsulated, included a ratio of menthol: silica:alumina of 0.44:1:0.75. The results show that even after storing the cigarettes for 30 days, the menthol flavor was retained in the silica and/or the migration of menthol to the carbon beads was minimized sufficiently such that the carbon beads were effective in reducing 1,3-butadiene, acrolein and benzene during smoking of the cigarette.

Figure 14:
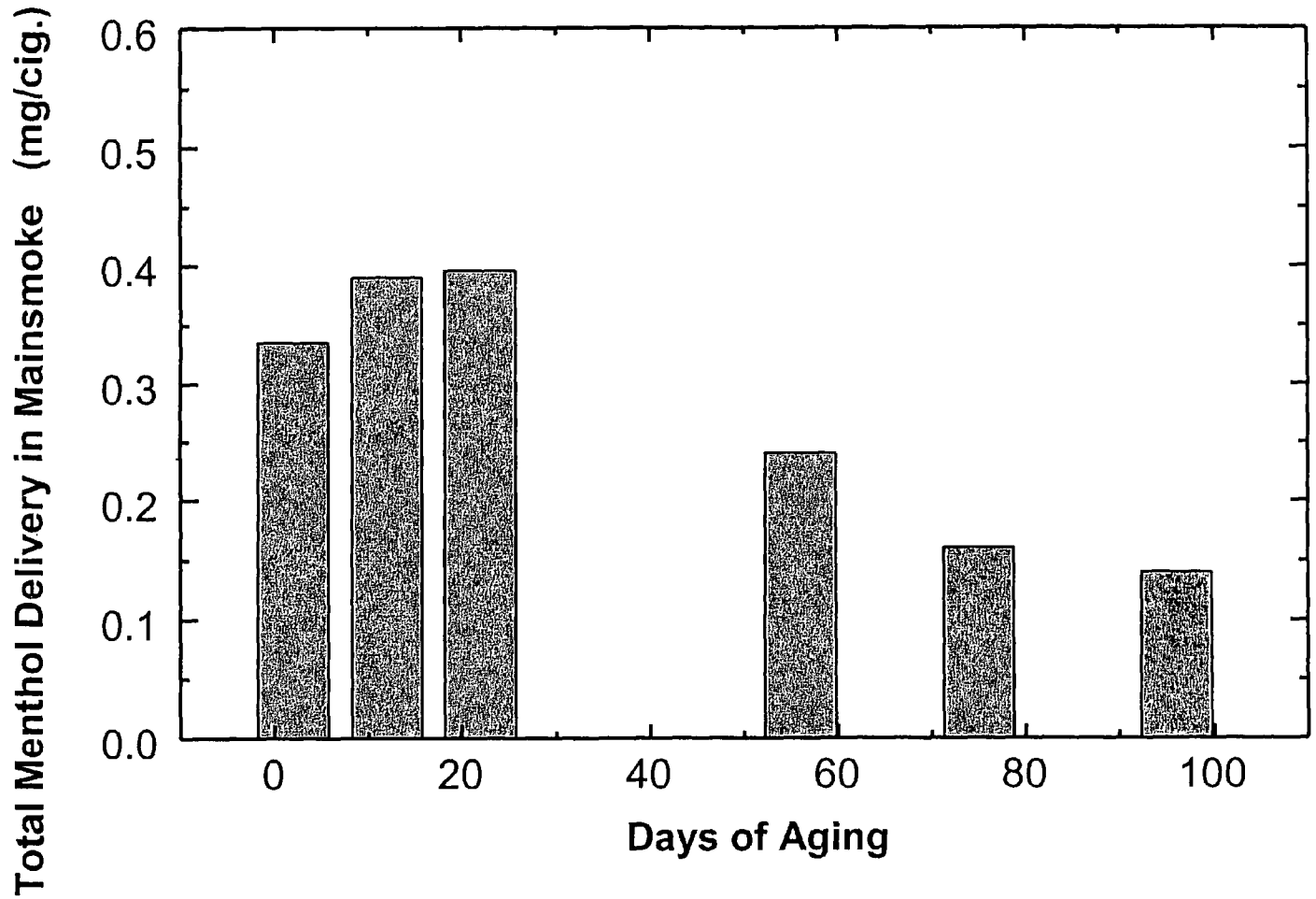
FIG. 14 is a graph of total menthol delivery versus time (in days) for a prototype D cigarette.

In FIG. 14, the total menthol delivery from the mentholated silica filter segment is shown as a function of time. After 20 days of storage the total menthol delivery is not substantially reduced, and after about 50 days of storage the menthol delivery is about 70% of its initial value.

The results above indicate that although the carbon sorbent may partially deactivate over time, flavor delivery and smoke constitutent reduction can be simultaneously achieved even after prolonged storage of the cigarettes. The incorporation of 95 mg (prototype B) or 150 mg (prototypes C-D) of the carbon sorbent into cigarette filters containing the flavor carrier can provide reduction in the concentration of 1,3-butadiene, acrolein and benzene in mainstream tobacco smoke during the smoking of test cigarettes subjected to storage for 20 days or longer.

While the invention has been described in detail with reference to specific embodiments thereof, it will be apparent to those skilled in the art that various changes and modifications can be made, and equivalents employed, without departing from the scope of the appended claims.

What is claimed is:

1. A smoking article having enhanced flavor comprising (i) a rod of tobacco, (ii) a flavor carrier comprising a mesoporous molecular sieve having a substantially uniform pore size of about 50 to 60 Å, and (iii)menthol as a flavor releasably disposed within said mesoporous molecular sieve, wherein said menthol is substantially encapsulated within the pores of said mesoporous molecular sieve with a water-soluble encapsulation material, and said water-soluble encapsulation material is adapted to dissolve and to release said menthol as a flavor to tobacco smoke upon contact with water vapor present in smoke formed during the smoking of said smoking article.

2. The smoking article of claim 1, wherein the pores of the sieve are sized to minimize migration of the flavor outwardly of the sieve prior to smoking the smoking article.

3. The smoking article of claim 1, wherein (a) the sieve has a surface area of 500 to 3000 $m^2/g$; (b) the sieve has a pore volume of 0.5 to 3 $cm^3/g$; and/or (c) the sieve has a particle size of between about 20 and 50 mesh.

4. The smoking article of claim 1, wherein (a) the sieve is silica-based, aluminosilicate-based or aluminophosphatebased, or (b) the sieve is selected from the group consisting of FDU-1, MCM-41, MCM-48, SBA-15 and combinations thereof.

5. The smoking article of claim 1, wherein the water-soluble encapsulation material is a sugar.

6. The smoking article of claim 1, wherein the sieve has (a) a surface area of 500 to 3000 $m^2/g$, (b) a pore volume of 0.5 to 3 $cm^3/g$, (c) a particle size of between about 20 and 50 mesh, and (d) the sieve is selected from the group consisting of FDU-1, MCM-41, MCM-48, SBA-15, and combinations thereof.

7. The smoking article of claim 1, comprising a microporous sorbent that is incorporated in the smoking article at a location upstream from the flavor carrier.

8. The smoking article of claim 1, comprising a filter having an upstream cavity therein, wherein a microporous sorbent is incorporated in the upstream cavity and the flavor carrier is incorporated in fibrous filter material downstream of the upstream cavity.

9. The smoking article of claim 8, wherein the microporous sorbent comprises particles of activated carbon incorporated in the upstream cavity, and the sorbent is separated from the tobacco rod by a first plug of cellulose acetate;

the flavor carrier is incorporated in the fibrous filter material and the flavor carrier is separated from the microporous sorbent by a second plug of cellulose acetate, and the flavor carrier is separated from a free end of the filter by a third plug of cellulose acetate.

10. The smoking article of claim 1, comprising a filter joined to the tobacco rod wherein the filter comprises a fibrous filter material and the flavor carrier is incorporated in and/or on the filter material.

11. The smoking article of claim 10, wherein the fibrous filter material comprises micro-cavity fibers.

12. The smoking article of claim 1, comprising a filter joined to the tobacco rod, the filter having a plug/space/plug configuration comprising:

an upstream plug of fibrous filter material;

a downstream plug of fibrous filter material, and a space between the upstream plug and the downstream plug, wherein the flavor carrier is incorporated in at least one of the upstream plug, the downstream plug or the space.

13. The smoking article of claim 12, wherein the space is substantially filled with particles of the flavor carrier.

14. A method of making the flavor carrier of claim 1, the method comprising combining a mesoporous molecular sieve with liquid menthol or a solution comprising menthol dissolved in a solvent, wherein the sieve and the menthol are combined by spraying the menthol on the sieve or in a fluidized bed.

15. A method of treating mainstream tobacco smoke comprising lighting the smoking article of claim 1 to form mainstream tobacco smoke, and drawing the mainstream tobacco smoke through the article such that the menthol is released into the mainstream tobacco smoke when the smoke contacts the flavor carrier.

* * * * *